US008133075B2

(12) United States Patent
Burns et al.

(10) Patent No.: US 8,133,075 B2
(45) Date of Patent: Mar. 13, 2012

(54) ELECTRICAL CONNECTOR AND METHOD OF MANUFACTURE

(75) Inventors: Thomas K. Burns, El Paso, TX (US); Dale A. Croasmun, Socorro, TX (US); Francisco Salas, Cuidad Juarez (MX)

(73) Assignee: FCI Americas Technology LLC, Carson City, NV (US)

( * ) Notice: Subject to any disclaimer, the term of this patent is extended or adjusted under 35 U.S.C. 154(b) by 0 days.

(21) Appl. No.: 12/730,745

(22) Filed: Mar. 24, 2010

(65) Prior Publication Data

US 2010/0248548 A1 Sep. 30, 2010

Related U.S. Application Data

(60) Provisional application No. 61/163,326, filed on Mar. 25, 2009.

(51) Int. Cl.
*H01R 13/40* (2006.01)

(52) U.S. Cl. ..... 439/595

(58) Field of Classification Search ..... 439/660, 439/885, 590, 591, 708, 710, 874, 595, 751
See application file for complete search history.

(56) References Cited

U.S. PATENT DOCUMENTS

| | | | | |
|---|---|---|---|---|
| 2,396,725 | A | 3/1946 | Thomas, Jr. | |
| 4,586,607 | A | 5/1986 | Dubbs et al. | |
| 4,753,003 | A | 6/1988 | Gobeil | |
| 5,725,392 | A | 3/1998 | Bianca et al. | |
| 5,830,012 | A | 11/1998 | Ortega et al. | |
| 5,967,841 | A | 10/1999 | Bianca et al. | |
| 7,361,060 | B2 * | 4/2008 | Russelburg | 439/660 |
| 7,824,173 | B2 * | 11/2010 | Nishida | 425/508 |
| 2005/0159038 | A1 | 7/2005 | Tsuchiya | |
| 2006/0216960 | A1 | 9/2006 | Chang | |

FOREIGN PATENT DOCUMENTS

JP 2000-077160 3/2000

OTHER PUBLICATIONS

PCT Application No. PCT/US2010/028637: International Search Report dated Nov. 3, 2010, 9 pages.

* cited by examiner

*Primary Examiner* — Javaid Nasri
(74) *Attorney, Agent, or Firm* — Woodcock Washburn LLP

(57) ABSTRACT

An apparatus and method are disclosed for manufacturing an electrical connector. A mold is presented having a pair of opposing dies that each define a mold pocket. The mold pockets of each die can be joined to form a mold cavity. Plastic can be injection molded into the mold cavity to form an electrical connector housing.

16 Claims, 26 Drawing Sheets

ELECTRICAL CONNECTOR AND METHOD OF MANUFACTURE

CROSS-REFERENCE TO RELATED APPLICATIONS

This application claims benefit under 35 U.S.C. §119(e) of provisional U.S. patent application No. 61/163,326, filed Mar. 25, 2009, the disclosure of which is hereby incorporated by reference in its entirety.

BACKGROUND

The instant disclosure is related to electrical connectors and more particularly to methods for making electrical connectors.

In the conventional injection-molding manufacture of electrical connectors, a mold is provided having a mold cavity that corresponds to a desired shape of an electrical connector housing. Injection molded plastic is introduced into the cavity, such that the plastic hardens to form an electrical connector housing having a plurality of openings extending therethrough that are each sized to receive a corresponding electrical contact. The openings are typically sized slightly smaller than the cross-sectional dimension of the electrical contacts such that the contacts can be press-fit inside the openings. However, the portion of the housing that defines the openings tends to cause shavings or slivers of metal to form along the contacts as the contacts are inserted in the opening. Because the shavings can tend to amass at locations proximate the outer housing surface, shavings of adjacent electrical contacts are able to contact each other, thereby having the undesirable effect of forming an electrical path between adjacent contacts.

What is therefore desired is an electrical connector that reduces the likelihood of electrical contact shavings from being brought into contact with shavings of adjacent electrical contacts.

SUMMARY

Disclosed herein are techniques for managing slivers of metal that sometimes shave from electrically conductive contacts as the electrically conductive contacts are stitched into an electrically insulative housing. Some electrically insulative materials, such a high temperature glass reinforced nylon, are hard enough to cause skiving. In one embodiment, slivers are reduced by molding an electrically insulative housing around the electrically conductive contacts to reduce skiving of the electrically conductive contacts by a mold and eliminate skiving of the electrically conductive contacts by the insulative housing.

A flexible seal (instead of steel) is used to prevent injection molded plastic or melt from entering post receptors in the mold. In another embodiment, any slivers that are formed when the electrically conductive contacts (which could be rectangular or square in cross-section) are stitched or pressed into corresponding interference portions of respective contact receiving openings (which could be round or circular in cross-section) are contained such that any slivers are electrically isolated within the insulative housing from an adjacent one of the electrically conductive contacts or any slivers from and adjacent one of the electrically conductive contacts.

In accordance with one aspect of the disclosure, a mold is configured to receive injection-molded plastic and produce an electrical connector. The mold includes a die defining a mold pocket configured to be joined with a complementary die having a mold pocket so as to define a mold cavity. The mold further includes at least one contact receptor extending from the die inside the mold pocket. The at least one contact receptor includes a contact receptor body defining a lower terminal end, an upper terminal end disposed opposite the lower terminal end, and a contact-receiving aperture extending into the contact receptor body. The lower terminal end has a cross-sectional dimension greater than that of the upper terminal end.

According to another aspect of the invention, a mold is configured to receive injection-molded plastic and produce an electrical connector. The mold may include a die defining a first mold pocket configured to be joined with a complementary die having a second mold pocket so as to define a mold cavity and a first contact receptor that extends from the die inside the first mold pocket, the first contact receptor may include a contact receptor body that may define a lower terminal end, an upper terminal end disposed opposite the lower terminal end, and a side wall extending between the upper and lower terminal ends, wherein the side wall at a first location and a second location disposed below the first location, such that the first location is disposed inward with respect to the second location. The side wall may define a portion that is angled inwardly along a direction from the lower terminal end toward the upper terminal end. An entirety of the side wall may be angled inwardly along a direction from the lower terminal end toward the upper terminal end. The side wall may define a frustum. The complementary dies may include a second contact receptor extending into the second mold pocket such that, when the first and second dies are joined, the mold pockets combine to form the mold cavity, and the first and second contact receptors are in vertical alignment and define a void therebetween.

DETAILED DESCRIPTION OF ILLUSTRATIVE EMBODIMENTS

Figure 1A:
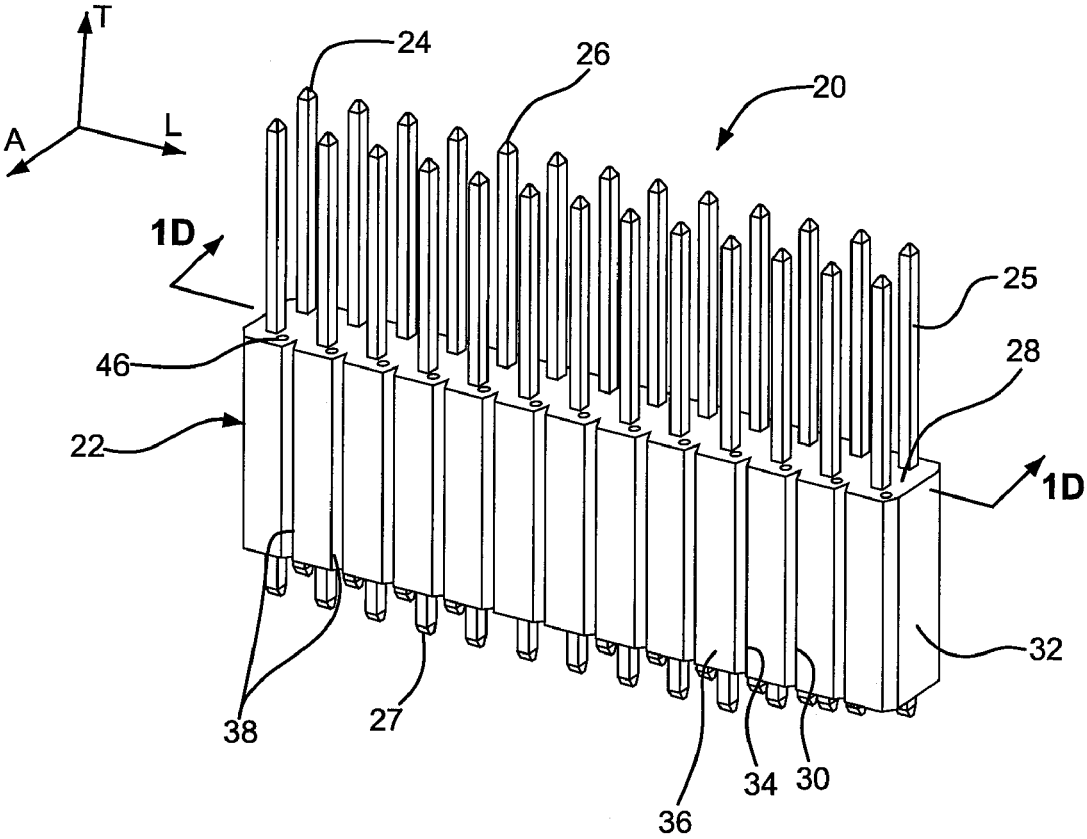
FIG. 1A is a top perspective view of an electrical connector including a connector housing that retains a plurality of electrical contacts, the connector constructed in accordance with one embodiment.
Figure 1B:
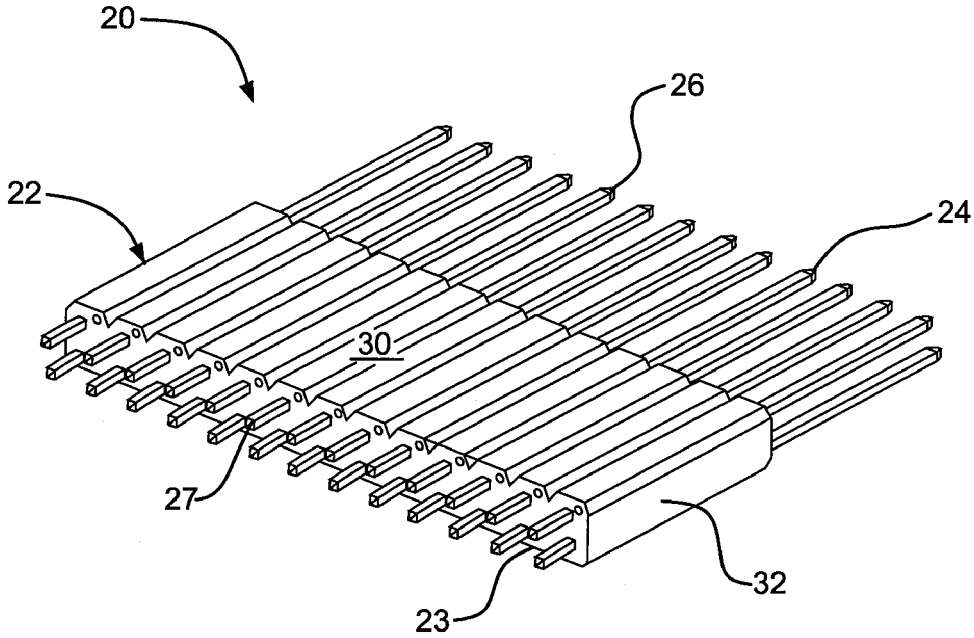
FIG. 1B is a bottom perspective view of the electrical connector illustrated in FIG. 1A.
Figure 1C:
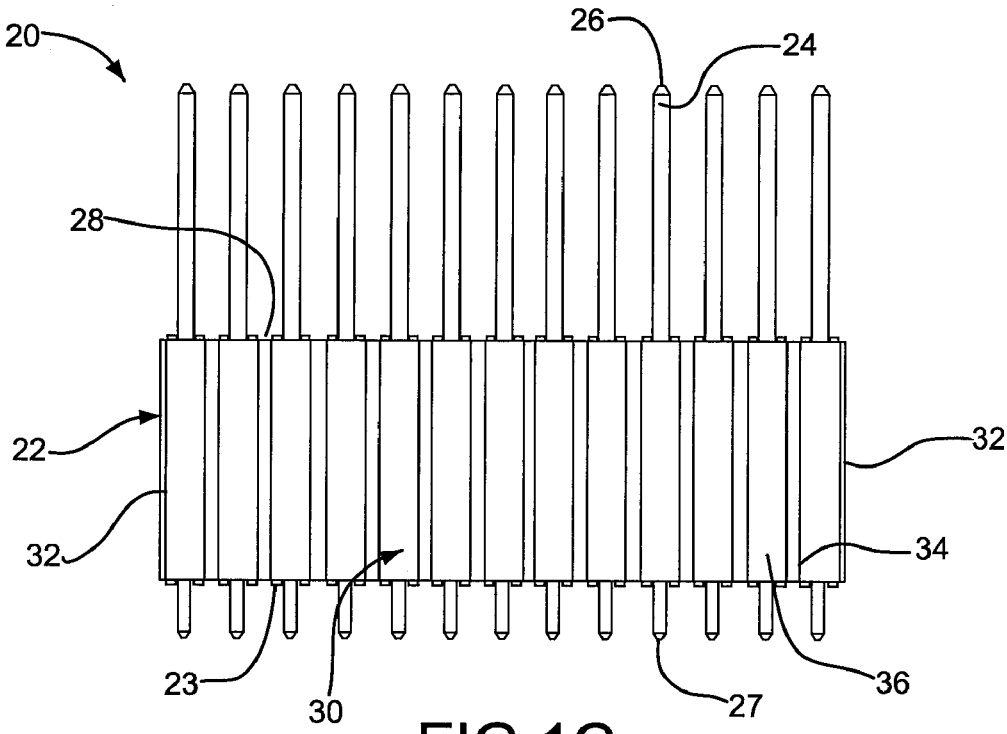
FIG. 1C is a side elevation view of the electrical connector illustrated in FIG. 1A.

Referring to FIGS. 1-4, an electrical connector 20 may include an insulative connector housing 22 that carries a plurality of electrically conductive contacts 24. The connector housing 22 can be made from any suitable dielectric material, such as plastic for example, that can be overmolded onto the contacts 24. The electrical contacts 24 are configured to carry electrical signals between a pair of electrical components, such as printed circuit boards, cables, complementary connectors, electronic devices, or the like. To this end, the electrical contacts 24 each define a contact body 25 that has a pair of opposing terminal ends 26 and 27 that can each be electrically connected to corresponding electrical components.

The housing 22 is illustrated as being generally rectangular in shape, and can extend horizontally along a longitudinal direction "L" and lateral direction "A", and vertically along a transverse direction "T". The connector housing 22 is elongate in the longitudinal direction L. Unless otherwise specified herein, the terms "lateral," "longitudinal," and "transverse" are used to describe the directional components of the connector 20 and other structure associated with the connector, unless otherwise indicated. The terms "inboard" and "inner," and "outboard" and "outer," "upper" and "lower" (and derivatives thereof) with respect to a specified directional component are used herein with respect to a given apparatus to refer to directions along the directional component toward and away from the center of the apparatus, respectively.

It should be appreciated that, although the longitudinal and lateral directions are illustrated as extending along a horizontal plane, and that the transverse direction is illustrated as extending along a vertical plane, the planes that encompass the various directions may differ during use, depending, for instance, on the desired orientation of the components described herein. Accordingly, the terms "vertical" and "horizontal" are used herein merely for the purposes of clarity and convenience, it being appreciated that these orientations may change during use.

The housing 22 defines opposing horizontal bottom and top walls 23 and 28, respectively, opposing vertical side walls 30 connected between the bottom wall 23 and the top wall 28, and a pair opposing end walls 32 connected between the bottom wall 23 and the top wall 28. The bottom and top walls 23 and 28, respectively, and the side walls 30 are longitudinally elongate.

The various walls of the housing 22 can be flat and smooth, or can define any desired texture. For example, in the illustrated embodiment, the side walls 30 can define a plurality of inwardly extending recesses 34 that, in turn, define vertical ribs 36 disposed between adjacent recesses 34. In particular, each rib 36 defines vertically elongate side surfaces 38 that extend laterally into the housing 22, and longitudinally outward toward the adjacent rib 36. Accordingly, adjacent side surfaces 38 of corresponding adjacent ribs 36 can define, or partially define, a recess having a triangular shape when viewed from above or below, or can define any alternative geometric shape as desired. The ribs 36 can provide engagement surfaces for automated equipment used to handle the electrical connectors 20. FIGS. 4A-E illustrate various other views of the connector housing 22.

Figure 2B:
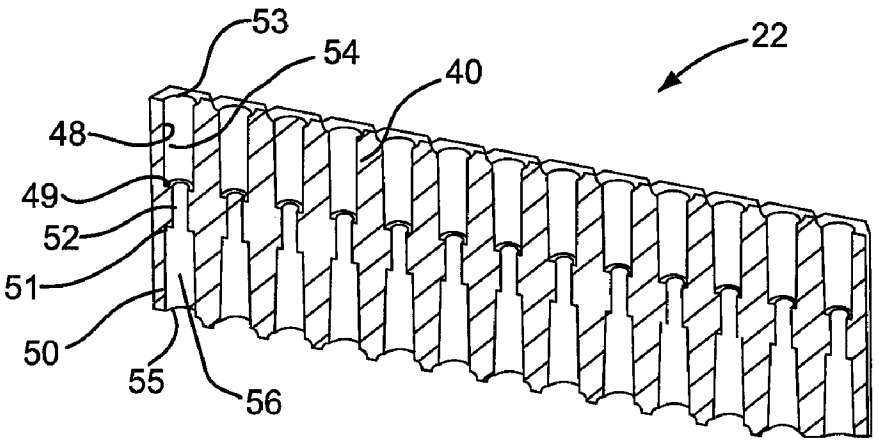
FIG. 2B is a sectional side elevation view similar to FIG. 1D, but with the electrical contacts removed.
Figure 2A:
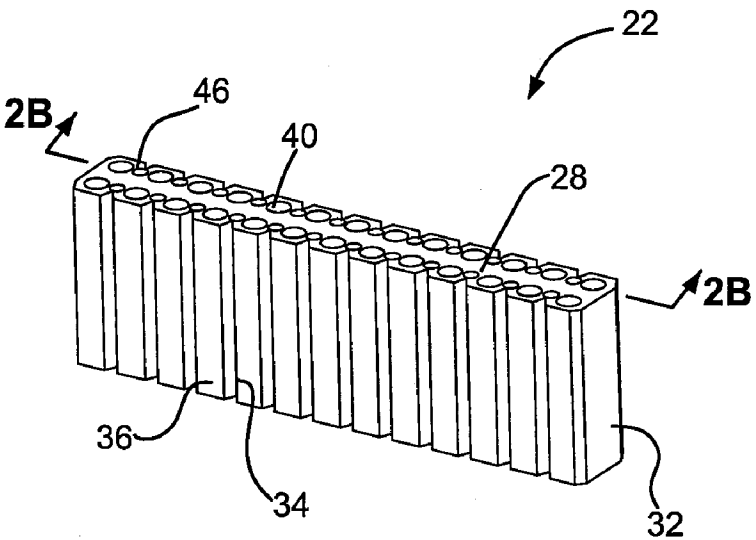
FIG. 2A is a perspective view similar to FIG. 1A, but with the electrical contacts removed.
Figure 3D:
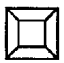
FIGS. 3A-E illustrate various views of the connector illustrated in FIG. 1A.
Figure 3E:
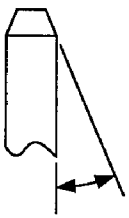
Figure 3C:
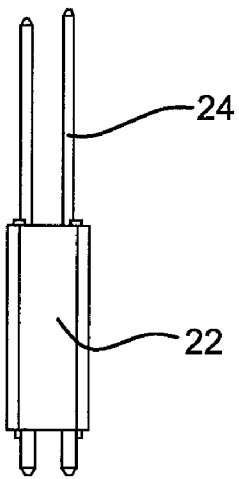
Figure 3A:
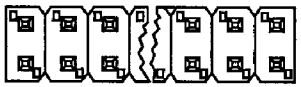
Figure 3B:
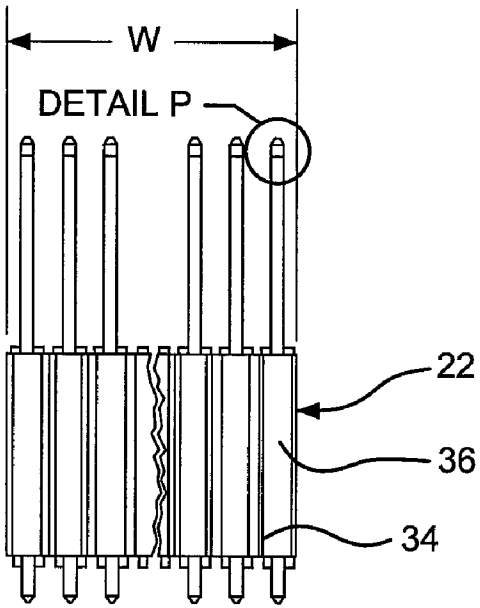
Figure 4D:
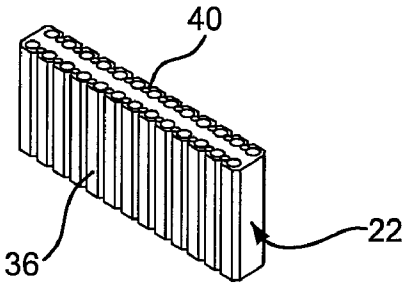
FIGS. 4A-E illustrate various views of a connector housing included in the connector illustrated in FIGS. 3A-E.
Figure 4E:
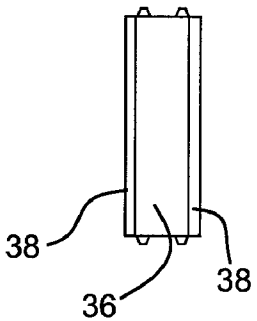
Figure 4A:
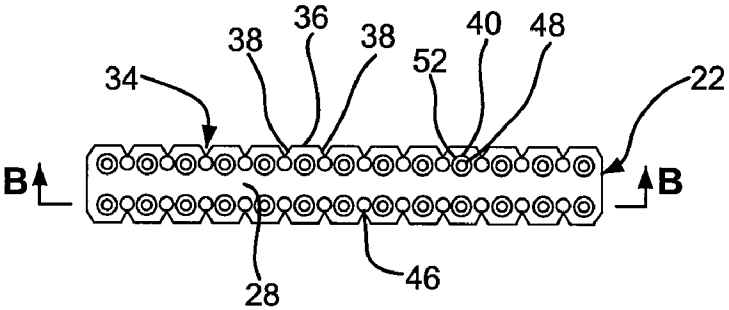
Figure 4B:
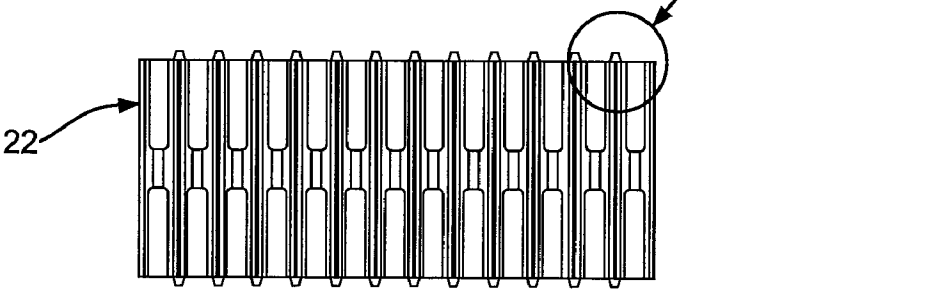
Figure 4C:
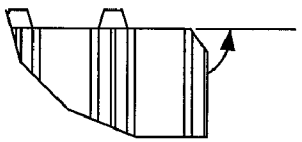

Referring also to FIGS. 2A and 2B, the contacts 24 extend vertically through the housing 22, and in particular through an corresponding array of vertically oriented contact-receiving openings 40 defined inside the housing 22. The contact-receiving openings 40 extend vertically through the housing, and in particular extend between the bottom and top walls 23 and 28, respectively. Accordingly, each contact 24 can extend through one of the openings 40, and vertically outboard of the corresponding bottom and top walls 23 and 28.

The terminal ends 26 and 27 of each contact can extend out from the top and bottom and top walls 28 and 23, respectively. The terminal ends 26 and 27 are exposed to the ambient environment, and are configured to electrically mate with complementary contacts of an associated electrical component. Alternatively, one or both terminal ends 26 and 27 can be disposed in the opening 40 at a position recessed with respect to the corresponding housing wall, as described in more detail below. Though the electrical connector 20 is a vertical connector, whereby contacts 24 extend vertically through the housing 22 as illustrated, it should be appreciated that the connector 20 can be alternatively be provided as a right-angle connector, whereby the terminal ends 26 and 27 are oriented perpendicularly with respect to each other.

With continuing reference to FIGS. 1-2, the connector housing 22 can include a plurality of dimples 46 extending outwardly from the bottom wall 23 and the top wall 28 at a location laterally adjacent the contact-receiving openings 40, or at any suitable alternative locations. The dimples 46 can have a dome-shaped surface defined by a radius, or any suitable alternative-shaped geometric structure. The dimples provide standoff with respect to complementary electrical components, such as a substrate, or printed circuit board, that are to be mated with the opposing terminal ends 26 and 27 of the electrical contacts 24, so as to create a spacing between the electrical component and its corresponding bottom wall 23 or top wall 28 to which electrical component interfaces.

As best shown in FIG. 2B, each contact-receiving opening 40 defines an upper contact-retention portion 48, a lower contact-retention portion 50, and a middle contact-engagement portion 52 disposed between the upper and lower portions. The upper and lower portions 48 and 50 define respective inner ends 49 and 51 connected to, or disposed adjacent, the middle portion, and opposing respective outer ends 53 and 55. The upper portion 48 can define the shape of a frustum whose outer, or upper, end 53 has a diameter greater than its inner, or lower, end 49. The upper portion 48 is thus defined by at least one side wall 54 that is angled with respect to the vertical direction. Likewise, the lower portion 50 can have the shape of a frustum whose outer, or lower, 55 end has a diameter greater than its inner, or upper, end 51. The lower portion 50 is thus defined by at least one side wall 56 that is angled with respect to the vertical direction.

Figure 1D:
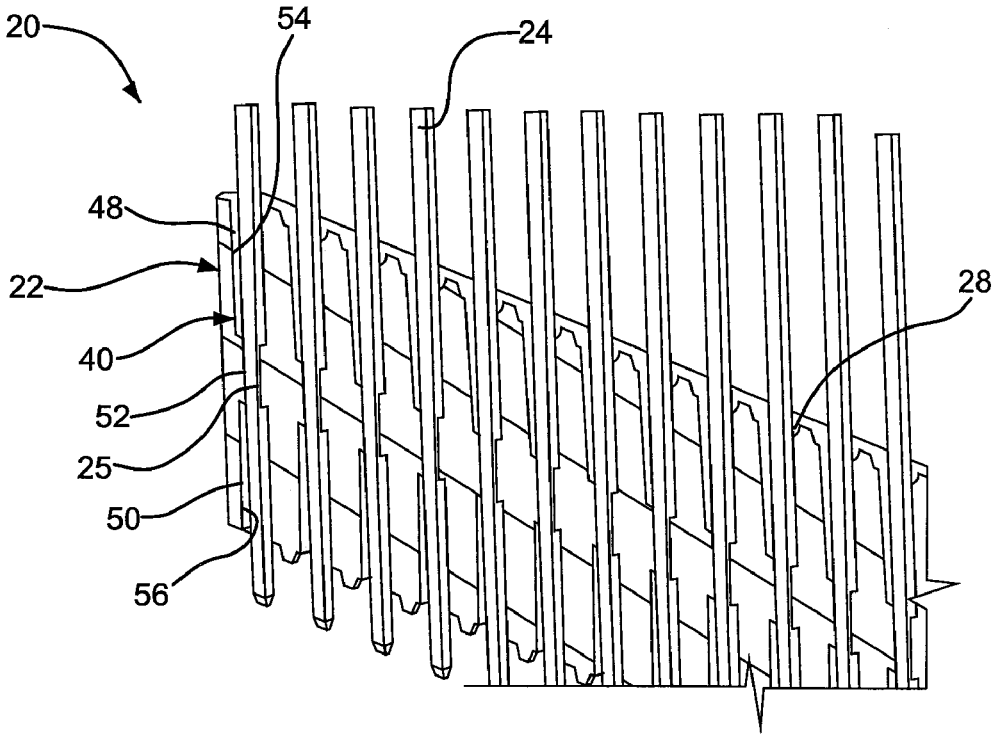
FIG. 1D is a sectional side elevation view of the connector illustrated in FIG. 1A, taken along line 1D-1D.

As shown in FIG. 1D, the upper portions 48 and the lower portions 50 surround the respective electrical contacts 24, and have a diameter that is greater than the cross-sectional dimension of the respective contacts 24 disposed therein. The middle portion 52 conforms to the shape of the respective contact 24, and engages a middle portion of the contact body 25 disposed between the terminal ends 26. The engagement between the portion of the housing 22 that defines middle portion 52 of the contact-opening 40 and the contact 24 retains the contact 24 in position in the housing 22.

The upper and lower portions 48 and 50 can be inverted with respect to each other, but assume an otherwise identical or substantially identical shape. The side walls 54 and 56 can be angled or sloped outwardly with respect to the vertical along a vertical direction from the middle portion 52 toward the respective top and bottom walls 28 and 23, respectively.

In particular, the side walls 54 and 56 can define an angle anywhere within a range that can have a lower end between and including 0° and 5°, including 0.5° and 1°, and an upper end between and including 1° and 20°, including 1.5°, 2°, 5°, 10°, and 15°. It should be further appreciated that, although the upper and lower portions 48 and 50 are frustums as illustrated, and thus define a circular cross sectional shape, they can alternatively define any suitable alternative cross sectional shape as desired, including square, rectangular, triangular, or any other polygonal shape. Accordingly, it should be appreciated that the upper and lower portions 48 and 50 can be defined by at least one wall that is angled with respect to the vertical as described above, or at least one wall having a portion that is angled with respect to the vertical as described above.

Figure 5:
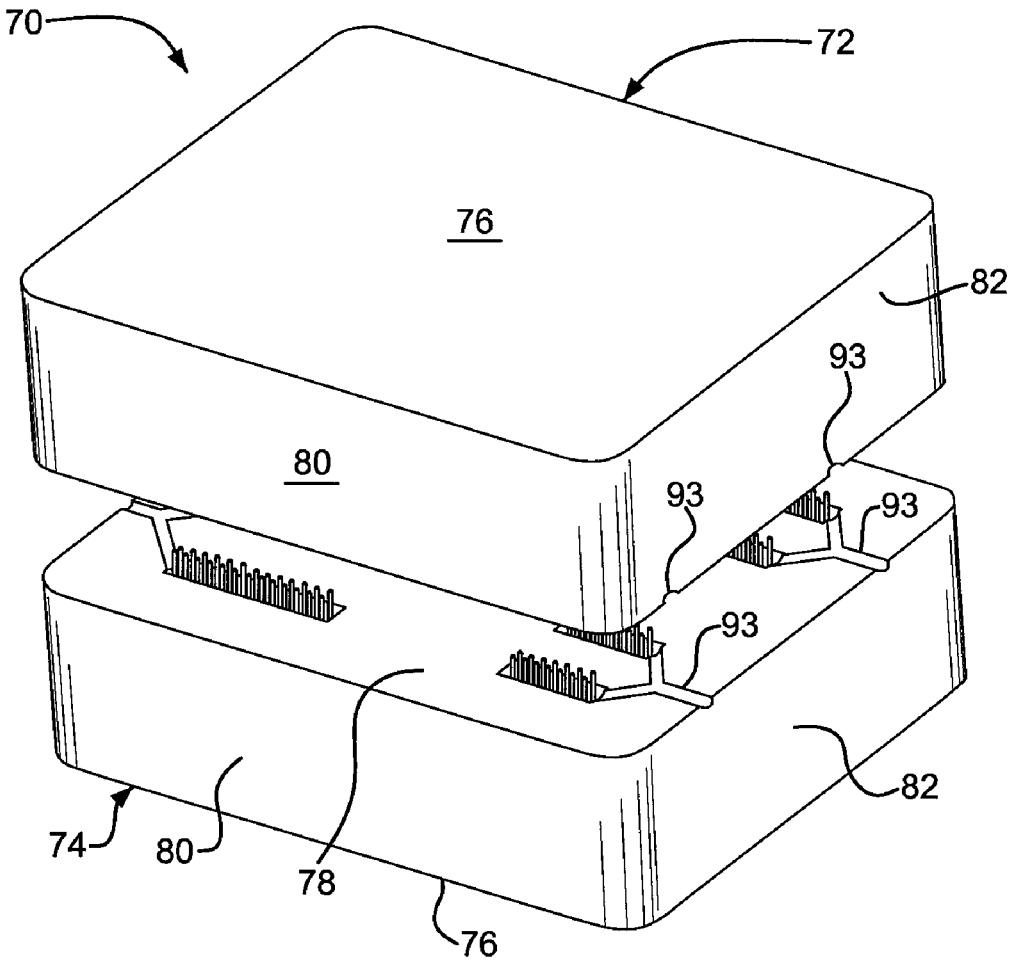
FIG. 5 is a perspective view of a mold including a pair of dies having aligned pockets that, in combination, are configured to receive molding compound and produce electrical connectors such as the electrical connector illustrated in FIG. 1A.
Figure 6:
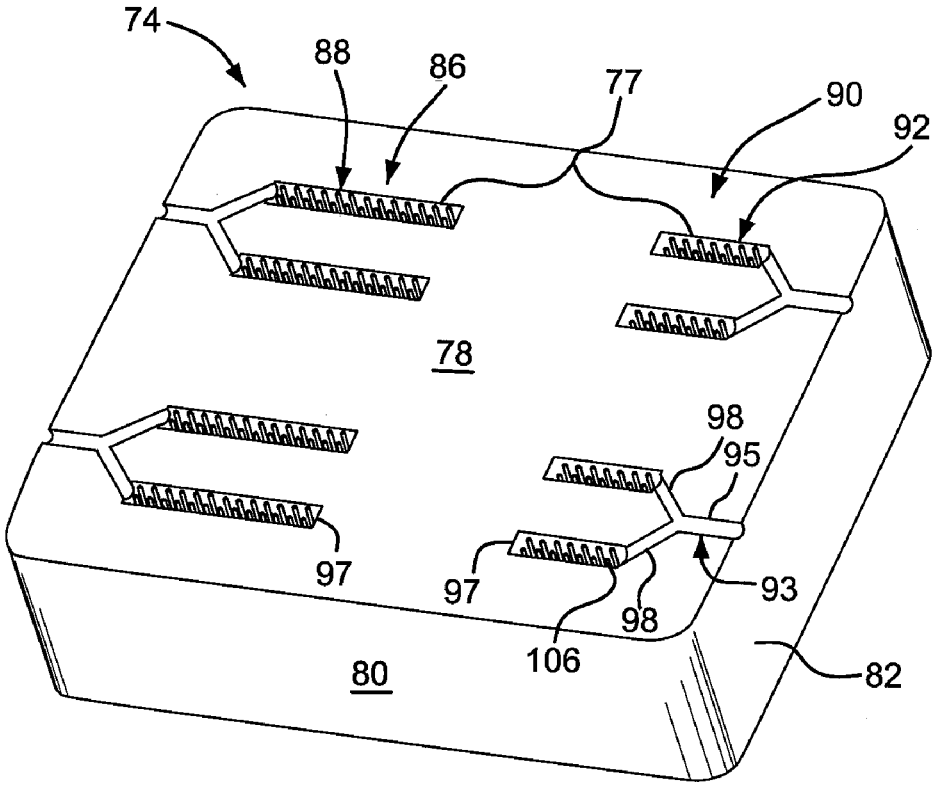
FIG. 6 is a perspective view of one of the dies illustrated in FIG. 5.

Referring now to FIGS. 5-6, a mold 70 includes an upper die 72 and a lower die 74. One of the dies may be movable with respect to the other, or both dies may be movable with respect to each other. The dies 72 and 74 can be identically constructed unless otherwise indicated, such that the mold can be formed by inverting the upper die 72 and joining the upper die 72 with the lower die 74. Accordingly, though the lower die 74 is described in detail herein, it should be appreciated that the description of the lower die applies to the upper die 72 unless otherwise indicated. The directional terms associated with the lower 74 are used to likewise describe the upper die 72, even though the upper die is inverted with respect to the lower die during use. Thus reference numerals as described with respect to elements of the lower die 74 also identify like structures illustrated with respect to the upper die 72. Of course, it should be appreciated that both dies need not be constructed identically so long as they are capable of forming a mold cavity configured to produce an electrical connector or electrical connector housing such as the connector 20 or housing 22 described above.

The lower die 74 includes opposing horizontal bottom and top surfaces 76 and 78, respectively, opposing longitudinally elongate vertical side surfaces 80 connected between the bottom surface 76 and the top surface 78, and a pair opposing end surfaces 82 connected between the bottom surface 76 and the top surface 78. The top surface 78 defines an engagement surface configured to engage the complementary engagement surface of the upper die 72.

Figure 7:
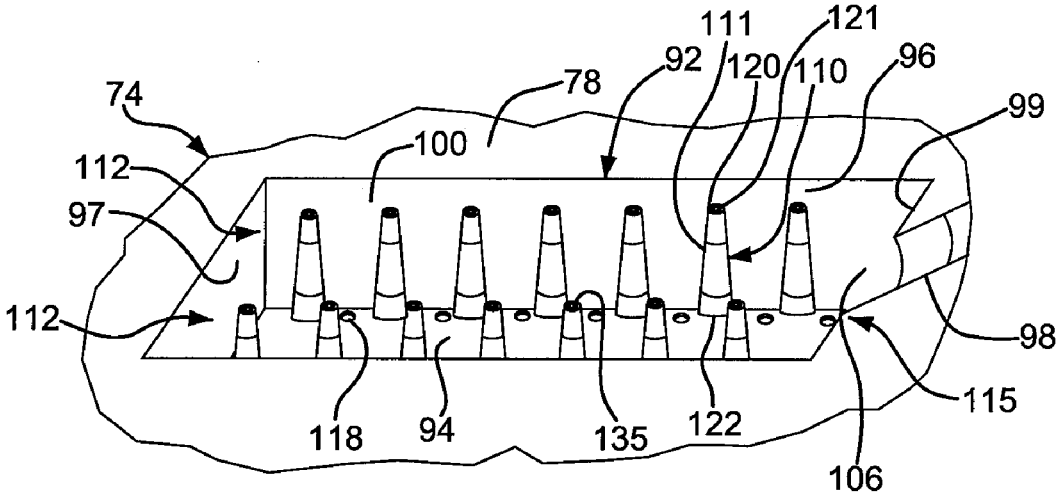
FIG. 7 is a detailed view of one of the pockets of the mold illustrated in FIG. 6.
Figure 9:
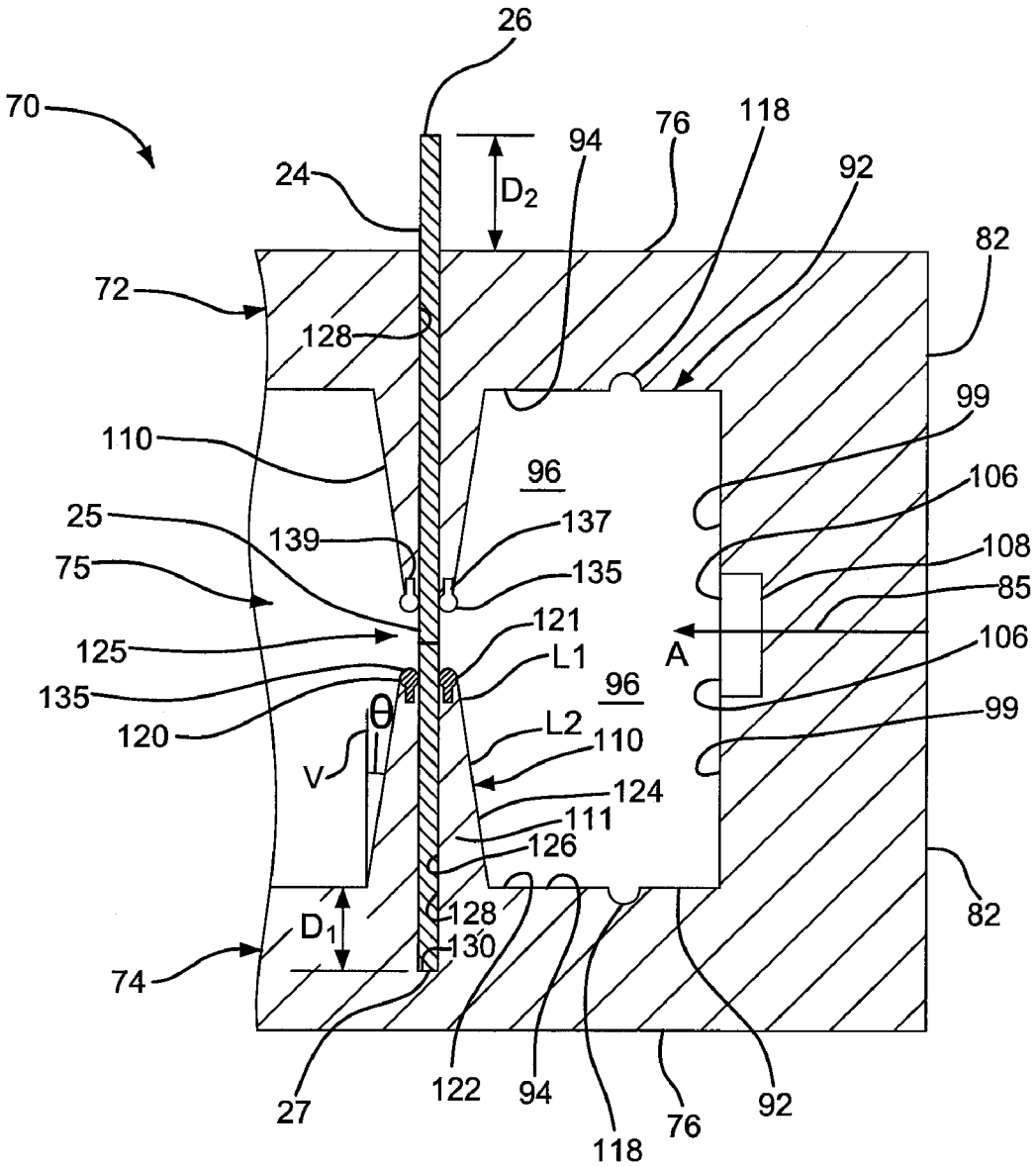
FIG. 9 is an enlarged sectional side elevation view through a portion of a mold of the type illustrated in FIG. 5.

The lower die 74 further defines an array of pockets 77 that extend from the top surface 76 vertically into the die 74. In the illustrated embodiment, the lower die 74 defines a first column 86 of a first plurality of mold pockets 88, and a second column 90 of mold pockets 92. Each column 86 and 90 includes four rows of a second plurality of pockets 88, such that the lower die 74 presents eight pockets 77 in total, though the number of pockets present in the lower die can vary, such that the lower die 74 includes at least one pocket. The pockets of the lower die 74 can be combined with the complementary pockets of the upper die 72 to form corresponding mold cavities when the dies 72 and 74 are brought together. One such mold cavity 75 is illustrated in FIG. 9. In this regard, once the upper die 72 is inverted, and the dies are brought together to form the mold cavity 75, it should be appreciated that the upper die 72 defines an upper wall of the mold cavity 75. An enlarged view of one of the pockets 92 is illustrated in FIG. 7.

In particular, the pocket 92 is defined a horizontal base 94, opposing longitudinally elongate vertical side walls 96 extending up from the base 94, and inner and outer end walls 97 and 99, respectively, connected between the side walls 96. Though the pocket 92 is thus illustrated as being generally rectangular, it should be appreciated that the pocket 92 can define any desired geometric shape and, in this regard, can include at least one side wall that can be linear or curved.

As described above, the horizontal base 94 of the upper die 72 defines an upper surface of the mold cavity 75 once the dies 72 and 74 are brought together. The pocket 92 defines an open upper end 100 configured to align with an upper end of a complementary pocket of the upper mold 72. It should be appreciated that pockets 88 can be constructed as described with reference to pockets 92. Accordingly, though one of the pockets 92 is described in detail herein, it should be appreciated that the description of the pockets 92 applies to the pockets 88 unless otherwise indicated. Thus reference numerals as described with respect to elements of the pockets 92 also identify like structures illustrated with respect to pockets 88. Of course, it should be appreciated that both columns of pockets 88 and 92 need not be constructed identically so long as they are capable of forming a mold cavity configured to produce an electrical connector or electrical connector housing 22 such as the connector 20 or housing 22 described above.

Though the side walls 96 are illustrated as presenting a flat inner surface, it should be appreciated that the inner surface of the side walls 96 can include a texture or contour that corresponds to a desired contour of the side walls 30 of the connector housing 22. For instance, the side walls 96 of the pocket 92 can present inner surfaces that have vertically extending ribs 102 and recesses 104 (see FIG. 8) that are sized and shaped to define the recesses 34 and ribs 36 described above when the pocket 92 is filled with injection molded plastic.

Referring again to FIGS. 6-7, the lower die 74 further includes a plurality of injection conduit sections 93, each having a main channel 95 that is connected to a pair of diverging forks 98 which, in turn, each define a terminal end that defines an injection port section 106 that extends through the outer end wall 99 of a corresponding one of the pockets 77. The injection conduit sections 93 extend vertically downward into the top surface 78 of the lower die 74. When the lower die 74 is joined to the upper die 72, the complementary top walls 78 define a centrally disposed seal line 85 at the interface thereof, and the pockets 77 form an interior mold cavity 75 in fluid communication with an injection port 108. During operation of the injection molding process, the injection molding material, such as plastic, flows through the injection conduits 102 and into the respective mold cavities along the direction of Arrow A. The injection molding material conforms to the contact receptors 110 and to the contacts 25 to define contact receiving openings such as the contact receiving openings 40 as described above.

With continuing reference to FIG. 7, the lower die 74 includes a plurality of contact receptors 110 in each pocket 77. For instance, pocket 92 contains receptors 110 extending vertically up from the base 94. The receptors 110 can be identically or substantially identically constructed as illustrated, and extend along two rows 112 in the illustrated embodiment. Each contact receptor 110 receives an electrical contact 24, and seals the respective contact 24 from the injection molding material. Each row 112 can include any desired number of receptors to produce an electrical connector having the desired number of electrical contacts. In the illustrated embodiment, each row 112 in pockets 92 contain seven receptors 110. Each row in pockets 88 includes thirteen receptors 110. The receptors in each row 112 can be laterally aligned with the receptors of the other row 112 as illustrated, or can be staggered if desired.

Referring now also to FIG. 9, the contact receptors 110 extend up from the base 94 a distance less than the height of the side walls 96 and end walls 97 and 99 of the corresponding die. The contact receptors 110 can be integrally formed with the base 94 or discreetly attached to the base 94 using any known fastener. Accordingly, each contact receptor 110 defines a contact receptor body 111 having an upper terminal end 120 that defines an upper surface 121 that is recessed with respect to the corresponding top surface 78 of the mold 74 (or seal line 85), and an opposing lower terminal end 122 disposed proximate to, and connected to, the corresponding base 94. As a result, a void 125 is disposed between the upper terminal ends 120, and in particular the upper surfaces 121, of aligned receptors 110 of the upper and lower dies 72 and 74. The seal line 85 can thus be in vertical alignment with the void 125. Though the upper surface 121 is illustrated as extending parallel or substantially parallel to the top surface 78 of the mold 74, it should be appreciated that the upper surface 121 can be angled with respect to the top surface 78, or assume any geometric shape as desired.

An elastomeric annular doughnut-shaped sealing member 135 can be threadedly inserted into the upper surface 121, such that the sealing member surrounds the electrical contact and prevents injection molded plastic from entering an opening 128 of the contact receptors 110 as described below. The sealing member 135 can be made from a cross-linked fluoro elastomer or silica elastomer.

The contact receptor bodies 111 can include a side wall 124 extending between, that can also be connected between, the upper end lower terminal ends 120 and 122. The side wall 124 can define the shape of a frustum, such that the lower terminal end 122 has a diameter greater than the upper terminal end 120. The frustum-shaped contact receptor body 111 can along a central vertical axis V that is substantially perpendicular to the base 94. The side wall 124 can thus be angled inwardly with respect to a vertical axis V in a direction from the lower end 122 toward the upper end 120, or in a direction toward the center of the mold cavity toward the void 125. In particular, the side wall 124 can define an angle θ anywhere within a range that can have a lower end between and including 0° and 5°, including 0.5° and 1°, and an upper end between and including 1° and 20°, including 1.5°, 2°, 5°, 10°, and 15°. The angled side wall 124 can.

It should be appreciated that, although the contact receptors 110 are frustums as illustrated, and thus define a circular cross sectional shape, they can alternatively define any suitable alternative cross sectional shape as desired, including square, rectangular, triangular, or any other polygonal shape. In this regard, though the lower end 122 has a diameter greater than that of the upper end 120 as illustrated, it should be appreciated that the lower end 122 can define a cross-sectional dimension along a direction parallel to the base 94, or along a horizontal plane "H," of any size or shape that is greater than that of the corresponding upper end 120. It should be further appreciated that in some embodiments, the lower end can have a cross-sectional area greater than that of the upper end.

It should be further appreciated that the contact receptors can be defined by at least one wall that is angled with respect to the vertical as described above. For instance, as illustrated in FIG. 9, the at least one side wall 124 defines a first location L1 and a second location L2 disposed below the first location L1. The first location L1 is disposed at a location that is disposed inward of the second location L2 with respect to the vertical axis V. Alternatively still, it should be appreciated that the at least one wall 124 may have a portion that extends substantially parallel to the vertical axis V, and a portion that is angled inwardly with respect to the vertical axis V as described above.

With continuing reference to FIG. 9, each receptor 110 can include a contact-receiving aperture 126 extending vertically into or through the receptor body 111. The aperture 126 can be centrally disposed with respect to the side wall 124, and can extend down from the upper end 120 through the bottom end 122, and can be aligned with an aperture 128 extending into the bottom surface 76 of the dies 72 and 74. The apertures 126 and 128 can have a cross section that is substantially equal to or greater that of the electrical contacts 24 such that the electrical contacts 24 can be press-fit or loosely fit inside the apertures 126 and 128. It should thus be appreciated that the sealing member 135 disposed at the upper terminal ends 120 of each contact receptor 110 forms a seal with the electrical contact 24 such that molten plastic is unable to flow through the apertures 126 and 128 via the upper surface 121. In this regard, the sealing member 135 can define an inner cross-sectional area that is slightly less than that of the electrical contact body 25, such that the sealing member 135 conforms to the shape of the contact body 25 as the contact 24 is inserted through the contact receptors 110. In this regard, the sealing member 135 can be coupled to a threaded flange 137 that is received in a corresponding threaded opening 139 extending into the upper surface 121. The threaded engagement between the flange and opening 139 maintain the vertical position of the sealing member 135 as the contacts 24 are inserted through the openings 138 of the contact receptors 110.

Moreover, it should be appreciated in one embodiment that the size of the aperture 126 can be configured to reduce the likelihood of metallic shavings of adjacent electrical contacts from contacting each other. For instance, the cross-sectional dimension (such as a diameter) of each aperture 126 can taper in a direction from the lower terminal end 122 toward the upper surface 121 of the corresponding contact receptors 110. The cross-sectional dimension of the aperture at a location proximate to the upper surface can be slightly less (on the order of thousandths of an inch) than the largest cross sectional dimension of the contact 24. As a result, if the contact receptor bodies 111 create shavings on the contacts 24 as the contacts 24 are inserted through the apertures 126, the shavings are unlikely to contact each other during operation of the connector. For instance, as each contact 24 is inserted into the receptors 110, any shavings created by the upper portion of the aperture 126 of the first receptor body 111 (with respect to the direction of insertion) will be disposed at a location in the receptor, while any shavings created by the upper portion of the aperture 126 of the second receptor body 111 will be disposed in the mold cavity 75. Accordingly, once the injection molded plastic is inserted into the mold and hardened, any shavings created will either be disposed in the openings 40 of the housing, or overmolded by the plastic of the connector housing 22, thereby ensuring that shavings of the various electrical contacts 24 are electrically isolated from each other.

Alternatively still, the cross-section dimension of the aperture 126 can taper from both ends 122 and 121 toward a middle portion of the aperture, such that the middle portion defines the region of smallest cross-sectional dimension (again, on the order of thousandths of an inch smaller than that of the contact 24). Accordingly, shavings created during insertion of the contact 24 into the first receptor body 111 will be disposed between the tapered middle portion and the lower terminal end 122, while shavings created during insertion of the contact 24 into the second receptor body 111 will be disposed between the tapered middle portion and the upper surface 121. Accordingly, once the injection molded plastic is inserted into the mold and hardened, any shavings created will either be disposed in the openings 40 of the connector housing 22 at a location between the middle portion and the bottom wall 23 of the housing 22, or between the middle portion and the top wall 28 of the connector housing.

It should be further appreciated that if the middle portion of the apertures 126 are tapered that either a seal can be placed at the upper end 121 of each contact receptor 110 to prevent injection molded plastic from entering into the aperture 126, or injection molded plastic can be allowed to enter the aperture and overmold the contacts at a location inside the aperture between the middle portion and the upper end 121.

In the embodiment illustrated in FIG. 9, the aperture 128 of the upper die 72 extends vertically through the bottom surface 76, while the aperture 128 of the lower die 74 terminates at a terminal end 130 disposed in the bottom surface 76. The aperture 128 of the lower die 74 defines a depth D1 with respect to the base 94 that can be any desired distance less than the vertical thickness of the upper surface 128 of the bottom wall 74. Accordingly, the contacts 24 can be inserted into the aperture 128 of the upper die 72, then through the apertures 76 of the upper and lower dies, and into the aperture 128 of the lower die 74. The depth D1 of the aperture 128 of the lower die thus determines the vertical position of the contacts 24 during the injection molding process. When the contact 24 is installed, a first, or lower, terminal end 26 extends a first distance D1 below the mold cavity 75, and a second terminal end 27 extends above the mold cavity by a second distance D2, which can be greater than or less than D1 as desired. A middle portion 29 of the contact 24, which is disposed between the terminal ends 26 and 27, is exposed in the void 125 between the upper terminal ends 120 of the contact receptors 110.

It should thus be appreciated that a method can be provided for constructing an electrical connector. The method can include the step of providing a first die that defines a first mold pocket and a first contact receptor disposed in the first mold pocket. The method can further include the step of providing a second die defining a second mold pocket and a second contact receptor disposed in the second mold pocket. The method can further include the step of joining the first and second dies, such that the first and second mold pockets combine to form a mold cavity, wherein the first and second contact receptors are aligned and define a void therebetween. At least one of the contact receptors defines a side wall that is angled inwardly in a direction toward the void in the manner described above.

The above-described method can further include the steps of introducing an injection molded plastic into the mold cavity, allowing the injection molded plastic to harden, and subsequently moving at least one of, or both of, the dies away from each other so as to remove the molded product from the mold cavity. The molded product can be an electrical connector constructed as described herein.

Figure 8:
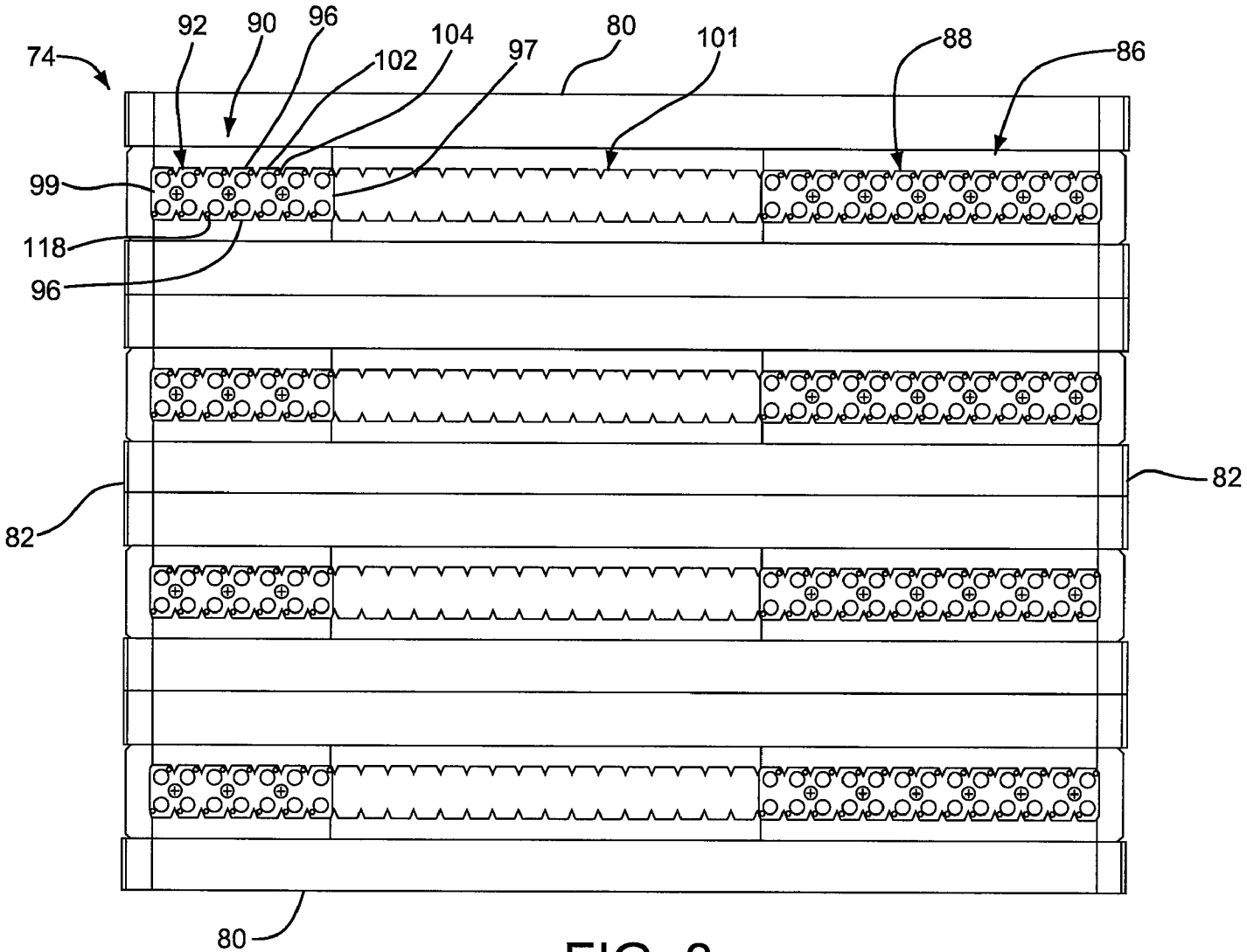
FIG. 8 is a detailed top plan view of the die illustrated in FIG. 6.

As shown in FIGS. 7 and 9, the lower die 74 can include additional structure in each pocket 77 as desired. For instance, as illustrated with respect to the pockets 92, a plurality of recesses 118 can extend vertically down into, but not through, the base 94. The recesses 118 can be arranged in a pair of rows (one such row 115 illustrated in FIG. 7) such that each recess is disposed laterally adjacent a corresponding contact receptor 110. The rows 115 can be disposed in longitudinal alignment with the contact receptors 110 as illustrated in FIG. 9. Alternatively, the rows 115 can be disposed at a location offset from the contact receptors, such that the recesses 118 are disposed laterally outward with respect to the corresponding contact receptors 110 as illustrated in FIG. 8. Alternatively still, the recesses 118 can be disposed anywhere in the pocket 92 as desired. When the upper die 72 and lower die 74 are brought into contact with each other, and the injection molded plastic is injected into the mold cavity 75, the plastic conforms to the shape of the recesses 118 to form dimples having a desired a size and shape such as the dimples 46 described above.

It should be appreciated that each pocket 88 and 92 can include any number of contact receptors 110 and recesses 118 as desired, depending for instance on the number of desired electrical contacts in the electrical connector produced from the mold cavity 75. The side walls and end walls of each pocket can likewise define any suitable length as desired.

The injection molding material, such as injection molded plastic, can be injected into the mold cavity 75 via the injection port 108 along the direction of Arrow A. The molten plastic fills the mold cavity 75, and conforms to the shape of the cavity 75, which can be defined by the walls of the pockets 77, the contact receptors 110, the middle portions 29 of the contacts 24, the recesses 118, and any additional structure placed therein. It should be appreciated that shape of the mold cavity 75 is not limited to being defined by the above-identified structure, and that certain structure may be removed.

Likewise, additional structure may be added to further define the shape of the mold cavity 75 as desired. Thus, the molten plastic hardens to produce an electrical connector, for instance of the type as described above with reference to electrical connector 20.

It should be appreciated that one example of a mold has been described in combination with mold 70, and that other molds may also be constructed in accordance with alternative embodiments. For instance, though various structure of the lower die 74 has been described that differs from like structure of the upper die 72, it should be appreciated that the upper die 72 could be alternatively or additionally constructed as described with the lower die 74, and the lower die 74 could be alternatively or additionally constructed as described with the upper die 72. Furthermore, though the mold 70 is configured to produce vertical connectors in the manner described above, it should be appreciated that dies can be alternatively provided having contact receptors of the type described above in combination with the contact receptors 110, but with the dies configured to create mold cavities suitable for producing a right-angle connector. Furthermore, a mold can be provided to produce a vertical connector in accordance with an alternative embodiment.

Figure 10:
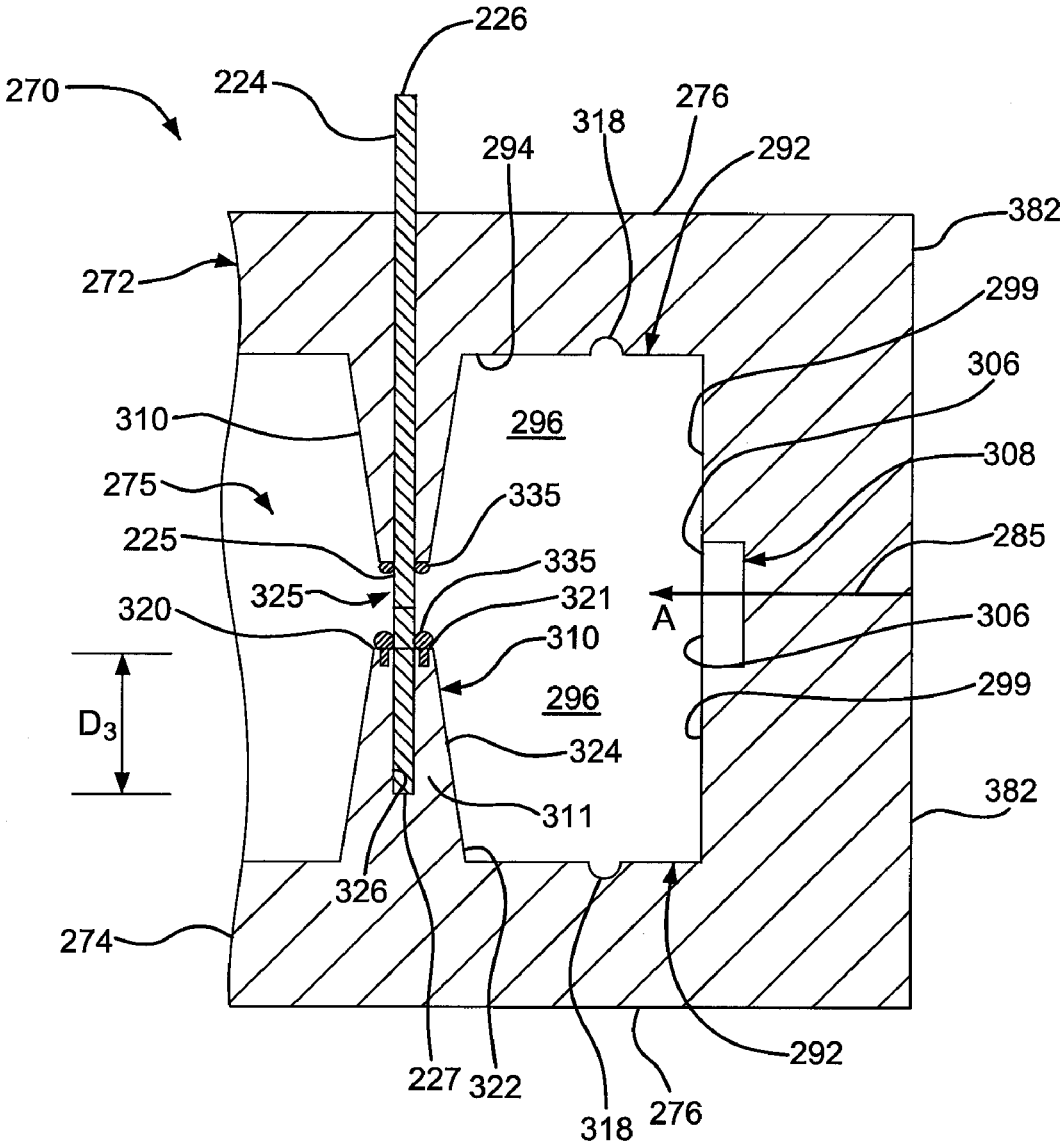
FIG. 10 a sectional side elevation view of the pocket similar to FIG. 9, but constructed in accordance with an alternative embodiment.

For instance, referring to FIG. 10, a mold 270 is illustrated having elements identified by reference numerals corresponding to like elements of the mold 70 incremented by 200. As illustrated, the aperture 326 of the lower die 274 extends vertically down from the upper terminal end 320 and terminates at a location above the lower terminal end 322 of the contact receptor 310. The lower die 274 thus does not include an aperture that is joined to aperture 326, such as aperture 128 described above.

In the embodiment illustrated in FIG. 10, the aperture 326 defines a distance D3 with respect to the base 294 that can be any desired distance less than the height of the contact receptor 310. The distance D3 determines a distance that the terminal ends 227 of the electrical contacts 224 can be inwardly recessed from a bottom wall of a connector housing, such as the bottom wall 23 of the connector housing 22 as described above.

Figure 11:
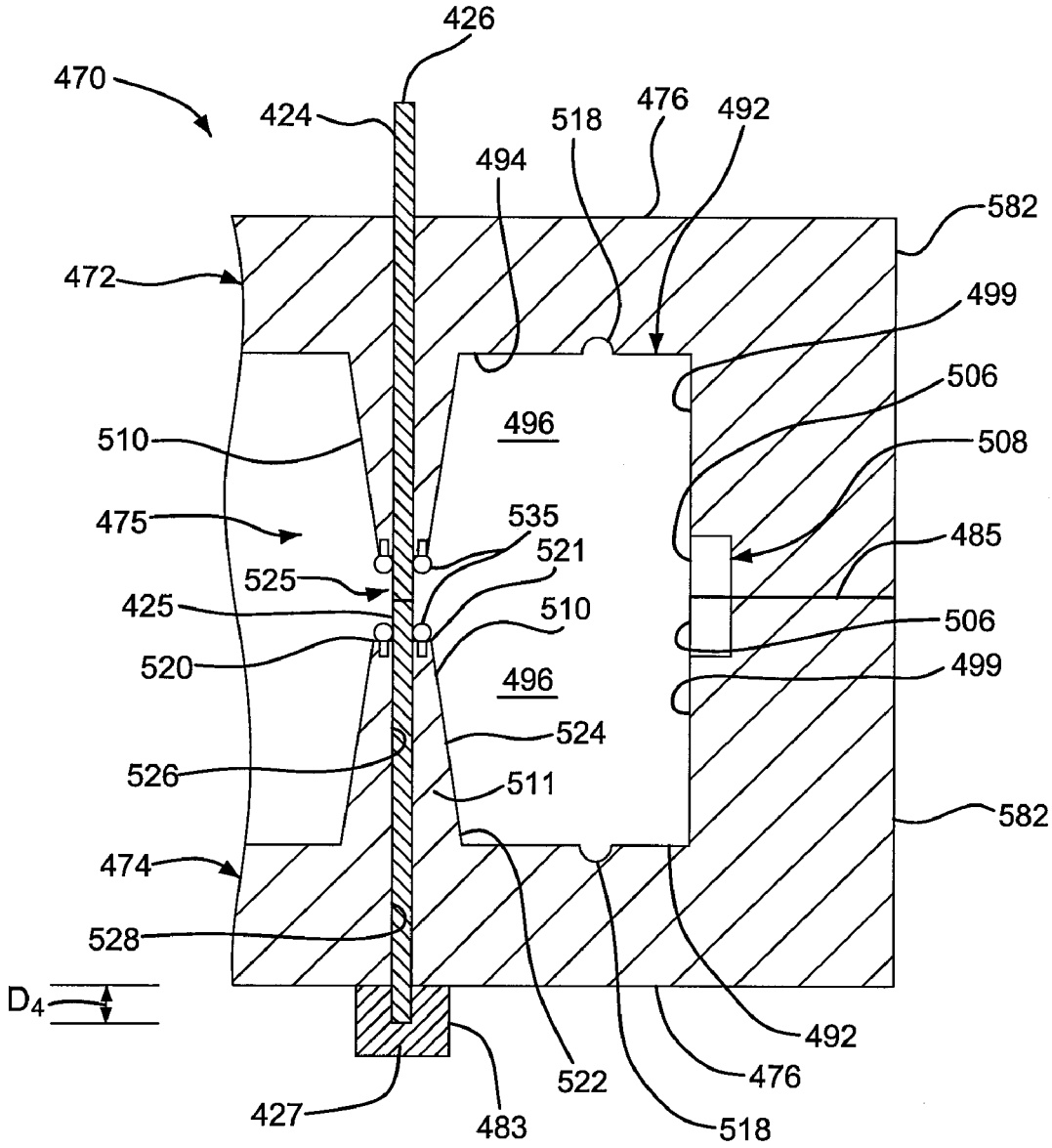
FIG. 11 a sectional side elevation view of the pocket similar to FIG. 9, but constructed in accordance with another alternative embodiment.

Referring now to FIG. 11, a mold 470 is illustrated having elements identified by reference numerals corresponding to like elements of the mold 70 incremented by 400. As illustrated, the aperture 526 can extend vertically through the receptor 510, and can be aligned with an aperture 528 that extends through the bottom wall 476 of the dies 572 and 574, in the manner described above with respect to the aperture 128 of the upper die 72 illustrated in FIG. 9. The mold 470 can further include a catch member 483 that is mounted onto the bottom surface 476 at a location outside the mold cavity 475. The catch member 483 can include a body 485 that defines a recess 487 in vertical alignment with the aperture 528. The recess 487 extends down from the upper surface of the body 485 and into the body, but does not extend through the body. The recess 487 can have a cross sectional dimension substantially equal to or greater than that of the terminal end 427 of the electrical contact 424 such that the contacts 424 can be press-fit inside the recess 487.

The terminal ends 427 of each contacts 424 can abut the terminal ends of the corresponding recesses 487 to set the vertical position of the contacts 424 with respect to the mold 470. For instance, the recess 487 can define a distance D4 with respect to the bottom surface 276 of the die 274 that can be any desired distance less than the height of the catch member 483. The distance D4 determines a distance that the terminal ends 227 of the electrical contacts 224 can extend outwardly from the bottom surface of a connector housing, such as the bottom wall 23 of the connector housing 22 as described above.

Figure 12:
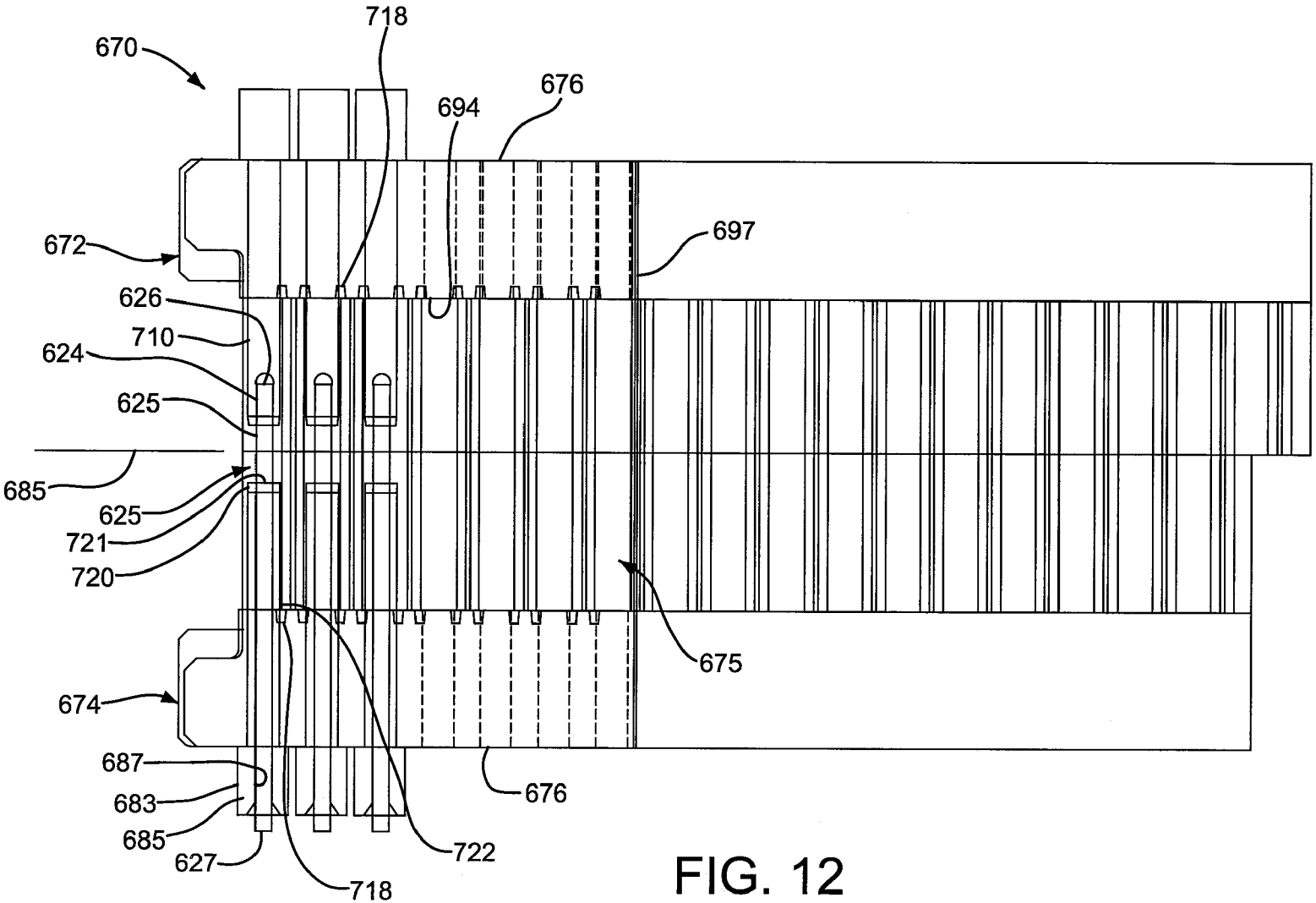
FIG. 12 is a sectional side elevation view through a portion of the pocket illustrated in FIG. 7, but constructed in accordance with yet another alternative embodiment.

Referring now to FIG. 12, a mold 670 is illustrated having elements identified by reference numerals corresponding to like elements of the mold 70 incremented by 600. As illustrated, the aperture 726 can extend vertically through the receptor 710, and can be aligned with an aperture 728 that extends through the bottom wall 676 of the dies 772 and 774, in the manner described above with respect to the aperture 128 of the upper die 72 illustrated in FIG. 9. The mold 670 can further include a catch 683 that is mounted onto the bottom surface of the base 694. The catch 683 can include a body 685 that defines a recess 687 in vertical alignment with the aperture 728 in the manner described above with reference to FIG. 11. However, the recess 687 illustrated in FIG. 12 extends through the body 485 such that the contact 624 can likewise extend through the body 485 such that the lower terminal end terminal end 627 is disposed below the body 485.

Referring now to FIGS. 13A-F and 14A-B, an electrical connector 820 is illustrated having elements identified by reference numerals corresponding to like elements of the electrical connector 20 incremented by 800 for the purposes of clarity and illustration. FIG. 15-17B illustrate a mold 870 configured to produce the electrical connector 820. FIGS. 15-17B illustrate the mold 870 as including elements identified by reference numerals corresponding to like elements of the mold 70 incremented by 800 for the purposes of clarity and illustration.

Referring to FIGS. 13A-F and 14A-B in particular, an electrical connector 820 may include an insulative connector housing 822 that carries a plurality of electrically conductive contacts 824. In one embodiment, the insulative connector housing 822 may define two adjacent contact-receiving openings 840 and two electrically conductive contacts 824. Each of the two electrically conductive contacts 824 may be received in a respective one of the two adjacent contact-receiving openings 840. Each of the two electrically conductive contacts 824 may be retained on the insulative connector housing 822 by an interference fit created between the insulative connector housing 822 and respective ones of the two electrically conductive contacts 824. The two contact-receiving openings 840 may each be sized and shaped to receive any respective electrically conductive shavings that may be created during insertion of a respective one of the two electrically conductive contacts 824 into the insulative connector housing 822. Stated another way, electrically conductive shavings from each of the electrically conductive contacts 824 are contained in a respective one of the two adjacent contact-receiving openings.

The connector housing 822 can be made from any suitable dielectric material, such as plastic for example, that can be overmolded onto the contacts 824. The electrical contacts 824 are configured to carry electrical signals between a pair of electrical components, such as printed circuit boards, cables, complementary connectors, electronic devices, or the like. To this end, the electrical contacts 824 each define a contact body 825 that has a pair of opposing terminal ends 826 and 827 that can each be inline with the contact body 825 and configured to be electrically connected to corresponding electrical components.

The housing 822 is illustrated as being generally rectangular in shape, and can extend horizontally along a longitudinal direction "L" and lateral direction "A", and vertically along a transverse direction "T". The connector housing 22 is elongate in the longitudinal direction L. Unless otherwise specified herein, the terms "lateral," "longitudinal," and "transverse" are used to describe the directional components of the connector 20 and other structure associated with the connector, unless otherwise indicated. The terms "inboard" and "inner," and "outboard" and "outer," "upper" and "lower" (and derivatives thereof) with respect to a specified directional component are used herein with respect to a given apparatus to refer to directions along the directional component toward and away from the center of the apparatus, respectively.

It should be appreciated that, although the longitudinal and lateral directions are illustrated as extending along a horizontal plane, and the transverse direction is illustrated as extending along a vertical plane, the planes that encompass the various directions may differ during use, depending, for instance, on the desired orientation of the components described herein. Accordingly, the terms "vertical" and "horizontal" are used herein merely for the purposes of clarity and convenience, it being appreciated that these orientations may change during use.

The housing 822 defines opposing horizontal bottom and top walls 823 and 828, respectively, opposing vertical side walls 830 connected between the bottom wall 823 and the top wall 828, and a pair opposing end walls 832 connected between the bottom wall 823 and the top wall 828. The bottom and top walls 823 and 828, respectively, and the side walls 830 are longitudinally elongate.

Figure 14A:
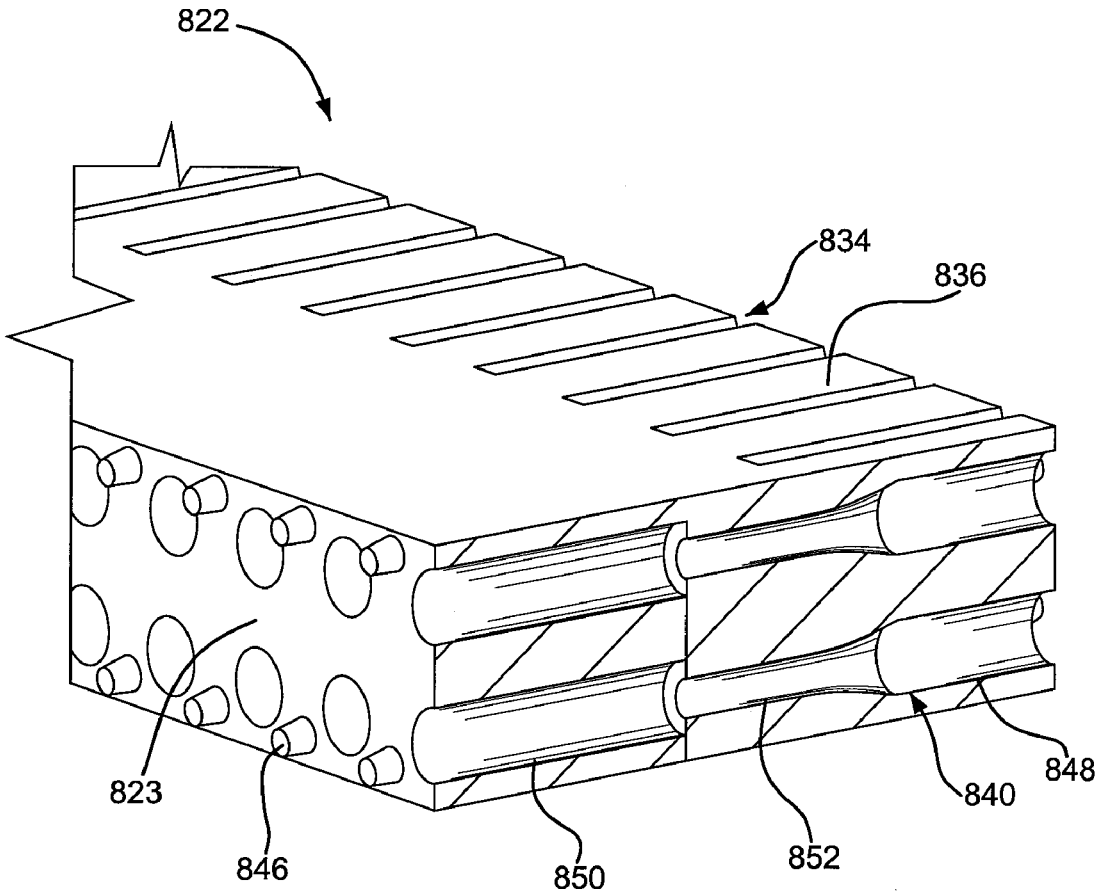
FIG. 14A is a sectional bottom end perspective view of a portion of the electrical connector illustrated in FIG. 13A, but with the electrical contacts removed.
Figure 14B:
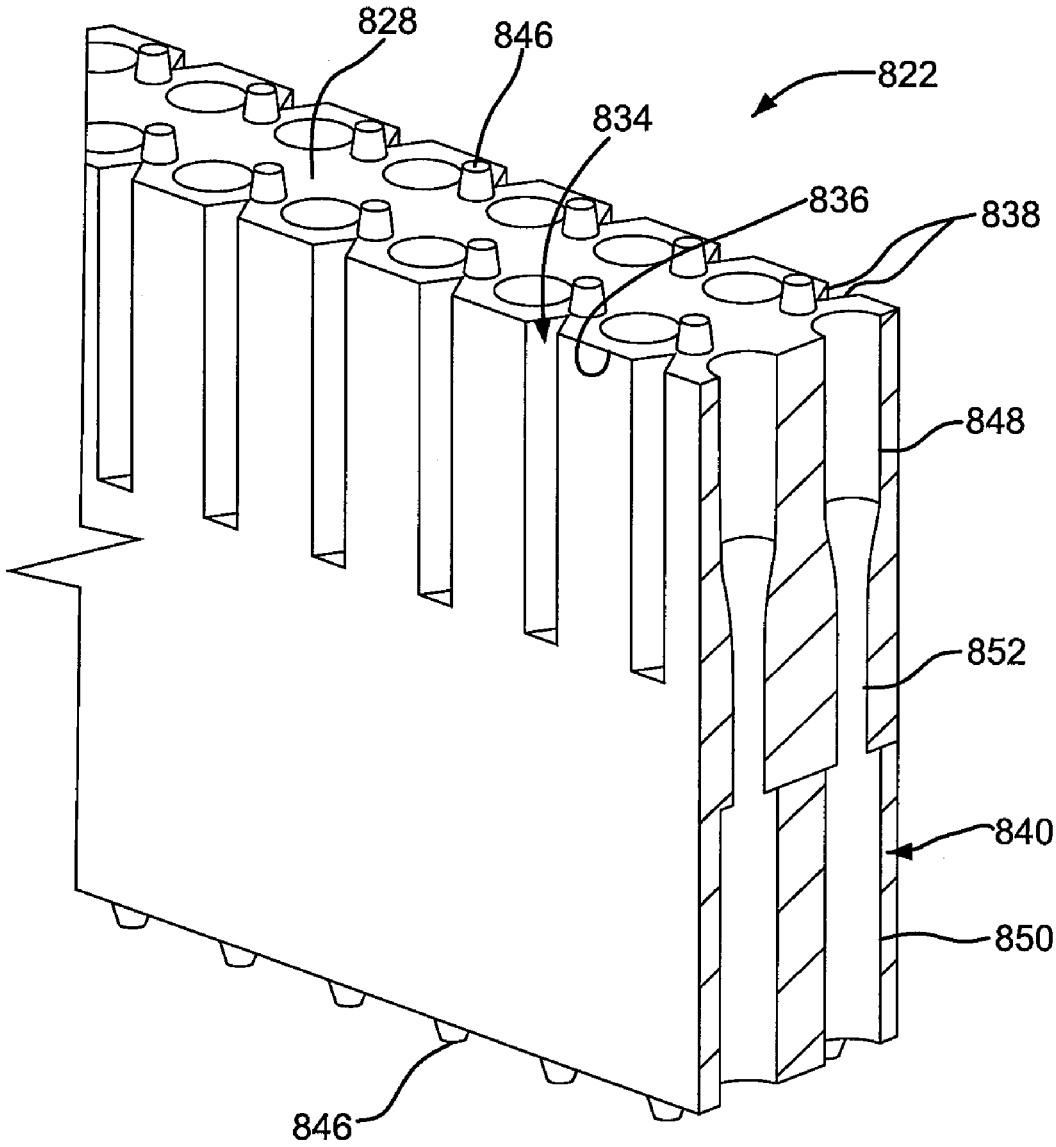
FIG. 14B is a sectional top end perspective view of a portion of the electrical connector illustrated in FIG. 13A, but with the electrical contacts removed.
Figure 15:
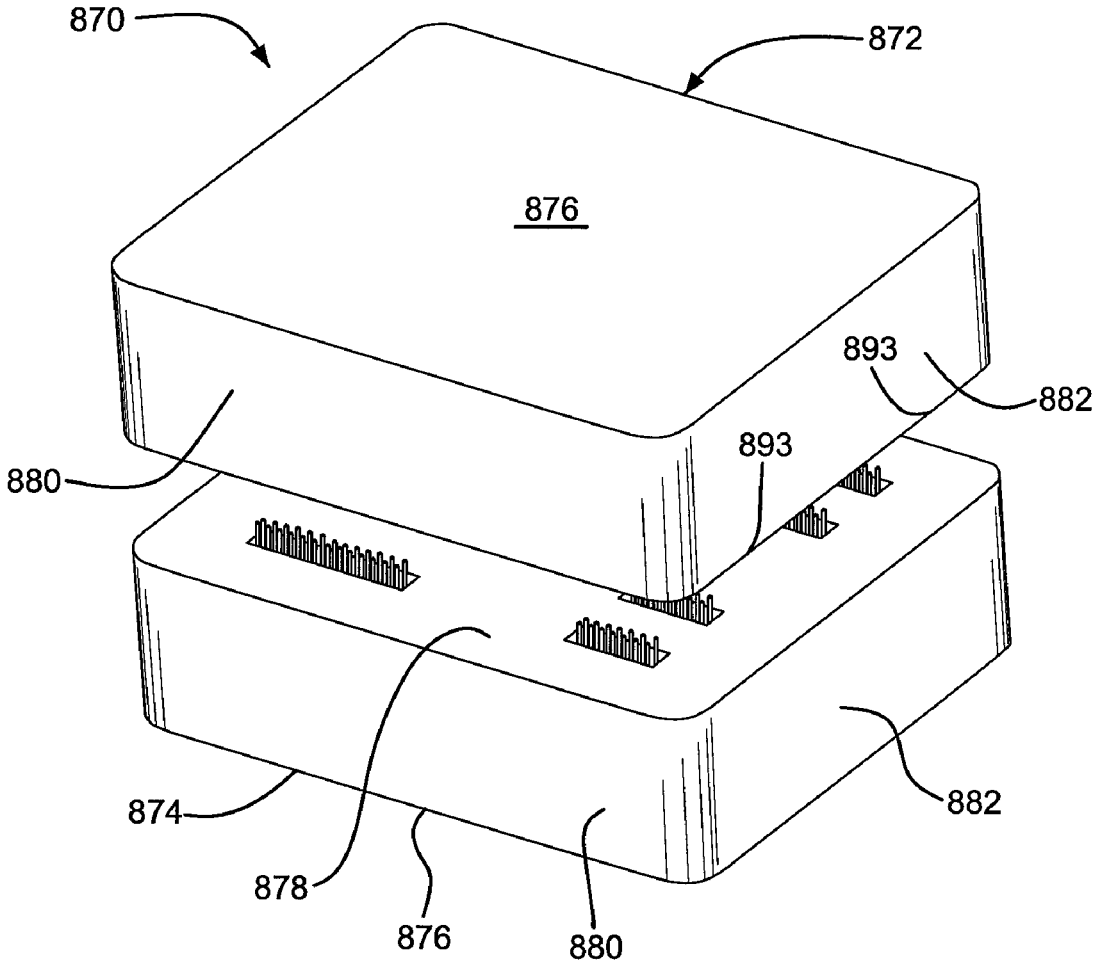
FIG. 15 is a perspective view of a mold including an upper die and a lower die that pockets that align and are configured to receive injection molded plastic and produce electrical connector housings such as the electrical connector housing illustrated in FIGS. 13A-14B.

As best shown in FIGS. 14A-B, the various walls of the housing 822 can be flat and smooth, or can define any desired texture. For example, in the illustrated embodiment, the side walls 830 can define a plurality of inwardly extending recesses 834 that, in turn, define vertical ribs 836 disposed between adjacent recesses 834. In particular, each rib 836 defines vertically elongate side surfaces 838 that extend laterally into the housing 822, and flare longitudinally outward toward the adjacent rib 836. Accordingly, adjacent side surfaces 838 of corresponding adjacent ribs 836 can define, or partially define, a recess having a triangular shape when viewed from above or below, or can define any alternative geometric shape as desired. The ribs 836 can provide engagement surfaces for automated equipment used to handle the electrical connectors 820.

Figure 13A:
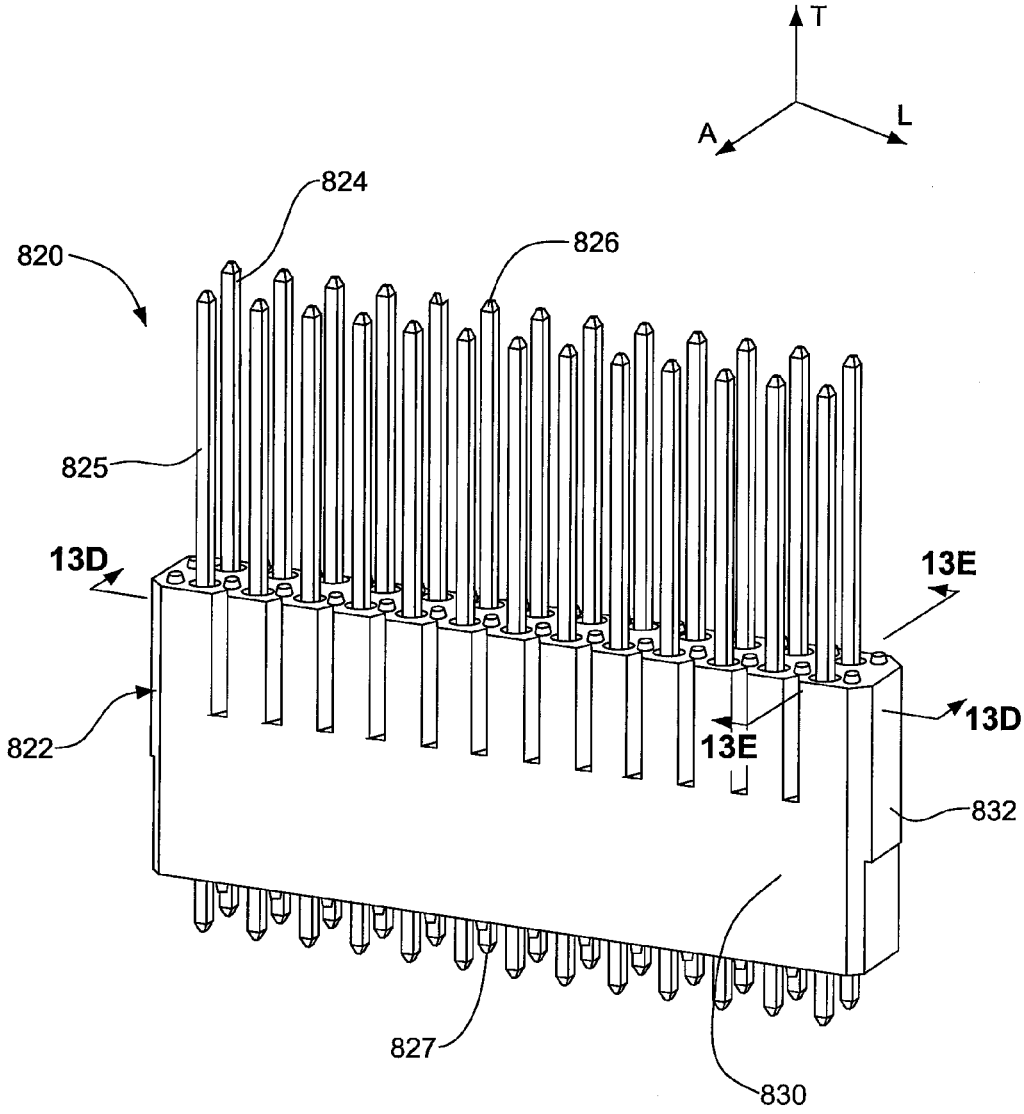
FIG. 13A is a top perspective view of an electrical connector including a connector housing that retains a plurality of electrical contacts, the connector constructed in accordance with an alternative embodiment.
Figure 13B:
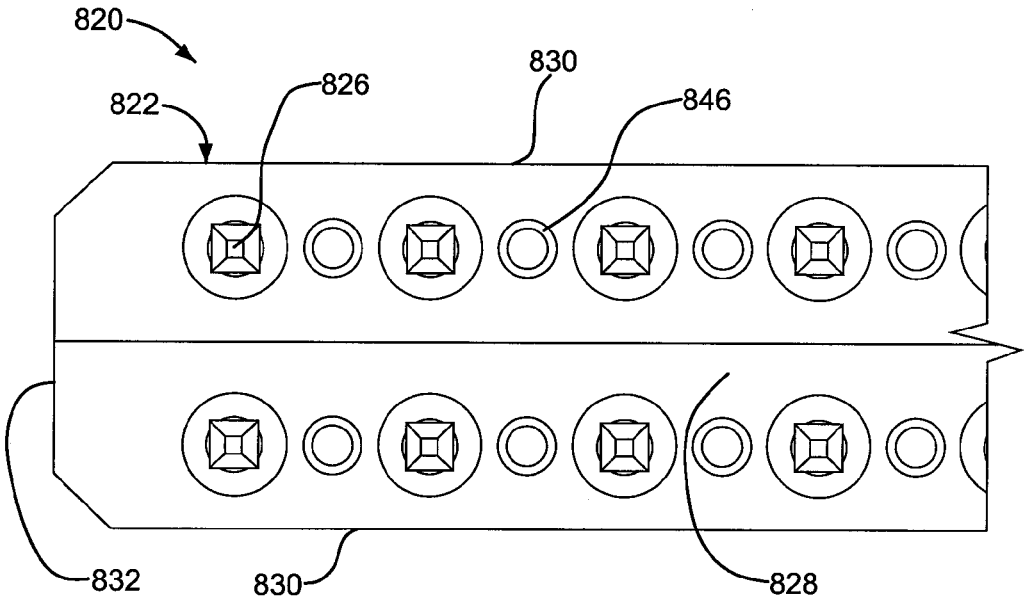
FIG. 13B is a top plan view of the electrical connector illustrated in FIG. 13A.
Figure 13C:
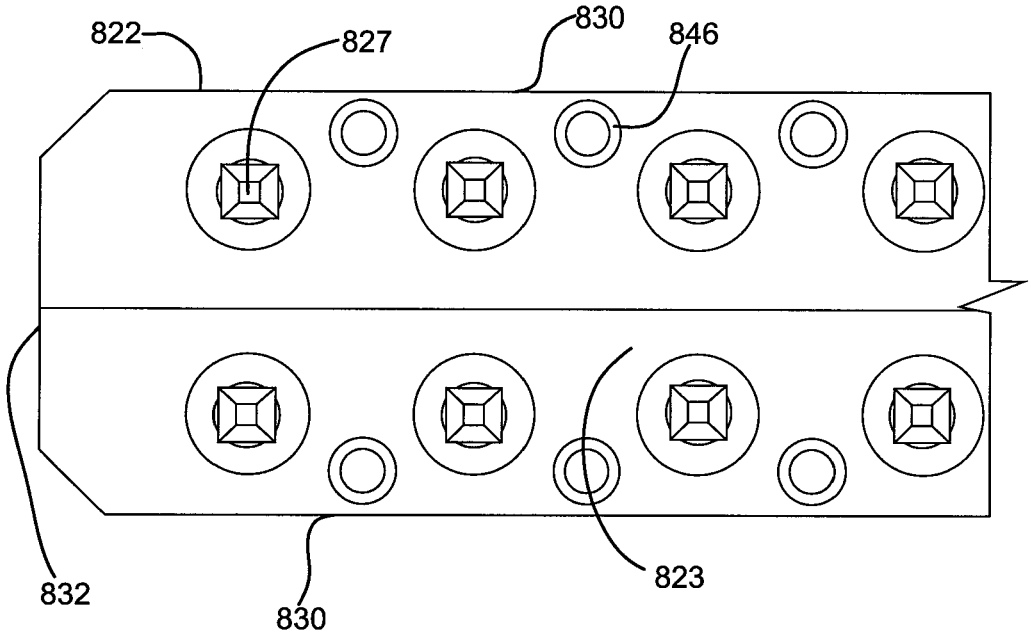
FIG. 13C is a bottom plan view of the electrical connector illustrated in FIG. 13A.
Figure 13D:
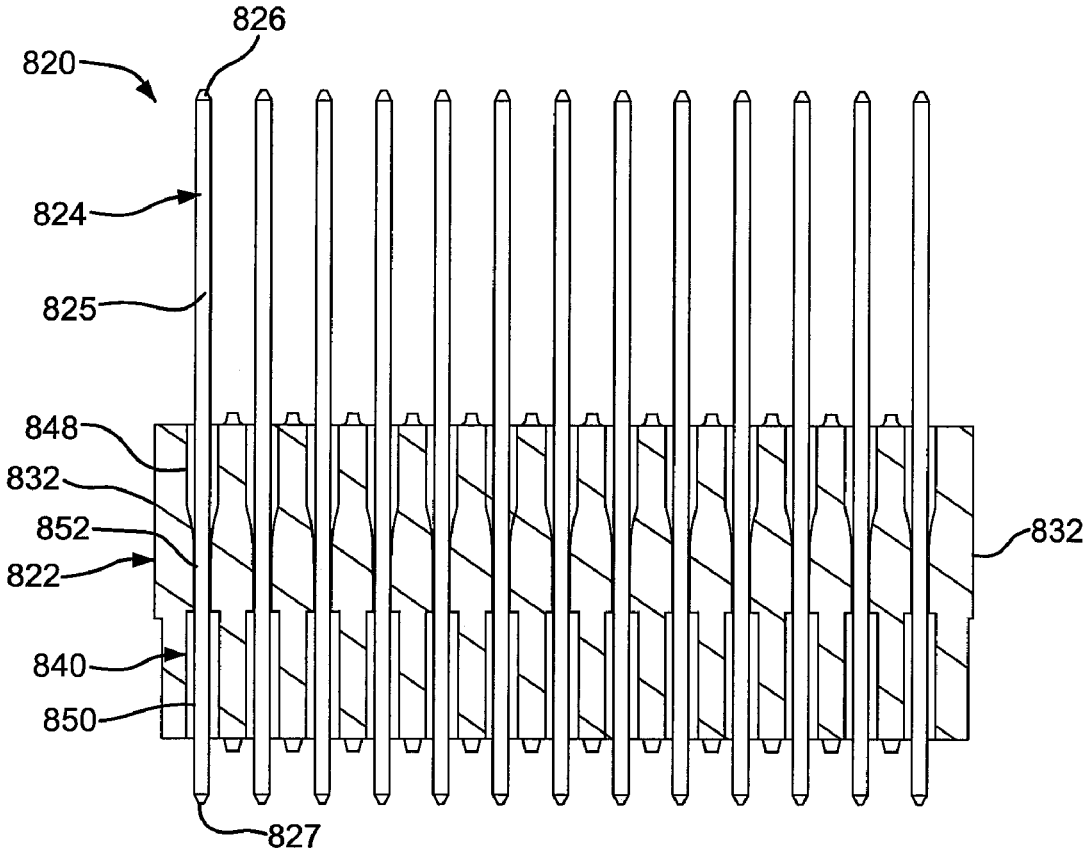
FIG. 13D is a sectional side elevation view of the connector illustrated in FIG. 13A, taken along line 13D-13D.
Figure 13E:
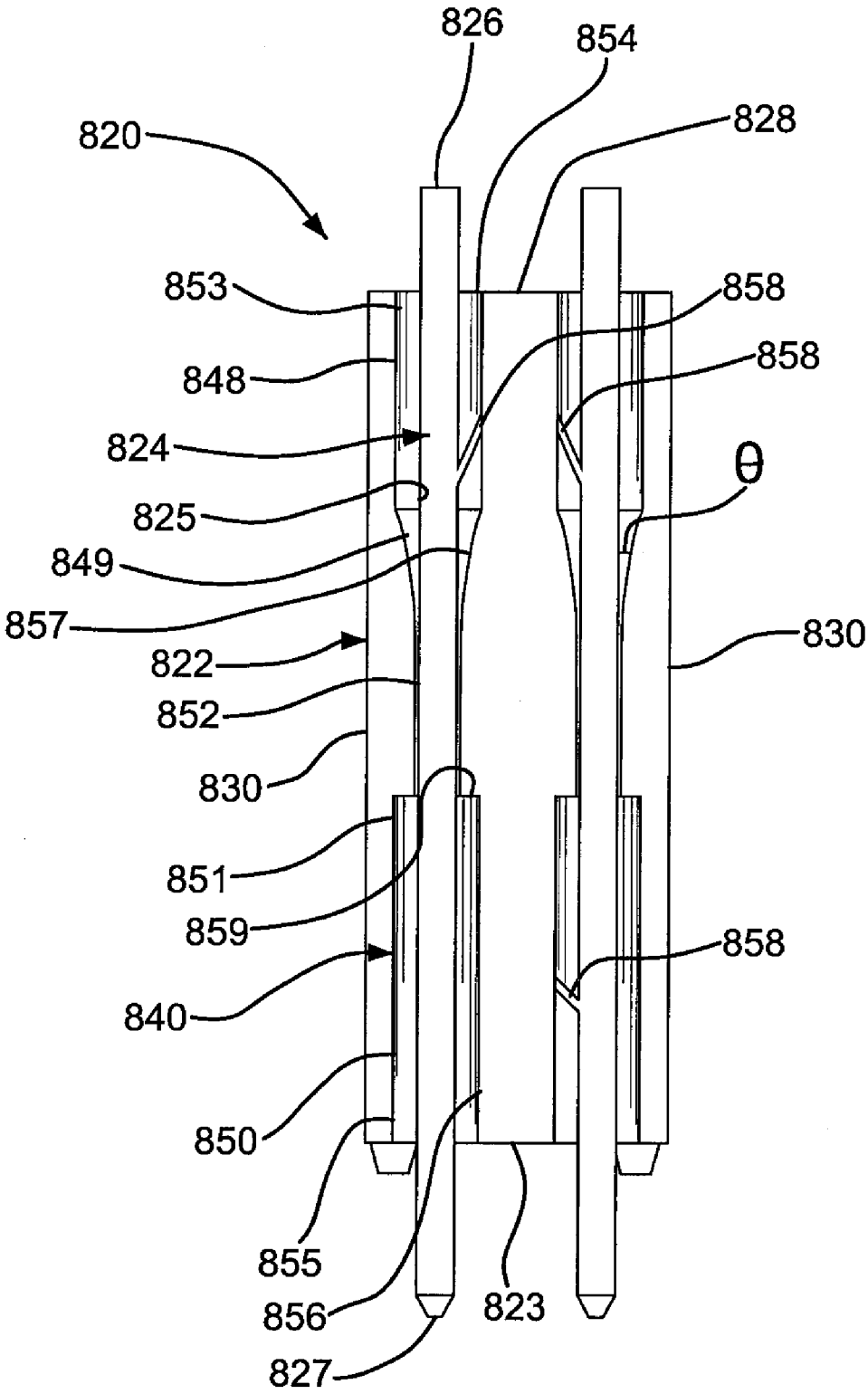
FIG. 13E is a sectional end elevation view of the connector illustrated in FIG. 13A, taken along line 13E-13E.
Figure 13F:
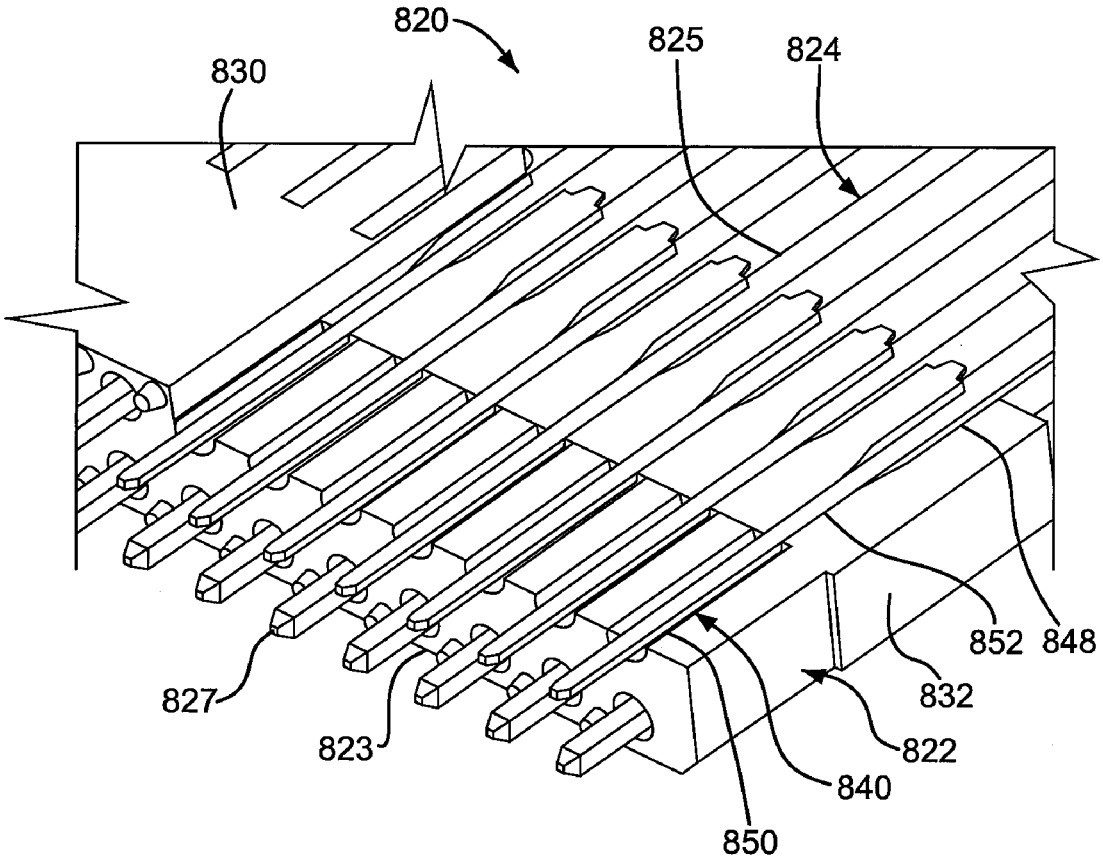
FIG. 13F is an enlarged bottom perspective view of a portion of the electrical connector illustrated in FIG. 13A, with a portion of the connector housing removed.

Referring also to FIGS. 13D-F, the contacts 824 extend vertically through the housing 822, and in particular through an corresponding array of vertically oriented contact-receiving openings 840 defined inside the housing 822. The contact-receiving openings 840 extend vertically through the housing, and in particular extend between the bottom and top walls 823 and 828, respectively. Accordingly, each contact 824 can extend through one of the openings 840, and vertically outboard of the corresponding bottom and top walls 823 and 828. In the illustrated embodiment, the bottom terminal ends 827 are inserted through the openings 840 in the top wall 828, and fed downward until the bottom terminal ends 876 project past the bottom wall 823.

Thus, the terminal ends 826 and 827 of each contact can extend out from the top and bottom and top walls 828 and 823, respectively. The terminal ends 826 and 827 are exposed to the ambient environment, and are configured to electrically mate with complementary contacts of an associated electrical component. Alternatively, one or both terminal ends 826 and 827 can be disposed in the opening 840 at a position recessed with respect to the corresponding housing wall, as described in more detail below. Though the electrical connector 820 is a vertical connector, whereby contacts 824 extend vertically through the housing 822 as illustrated, it should be appreciated that the connector 820 can be alternatively be provided as a right-angle connector, whereby the terminal ends 826 and 827 are oriented perpendicularly with respect to each other.

Each contact-receiving opening 840 defines an upper contact-retention portion 848, a lower contact-retention portion 850, and a middle contact-engagement portion 852 disposed between the upper and lower portions. The upper and lower portions 848 and 850 define respective inner ends 849 and 851 connected to, or disposed adjacent, the middle portion, and opposing respective outer ends 853 and 855.

The outer end 853 of the upper portion 848 can be substantially cylindrical, or define the shape of a frustum whose outer, or upper, end has a diameter greater than its inner, or lower, end. The outer end 853 is thus defined by at least one side wall 854 that can extend substantially parallel to the vertical direction, or can be angled with respect to the vertical direction. The inner end 849 of the upper portion 848 can define a contact guide surface 857 that has an outward curvature in a direction from the middle contact-engagement portion 852 toward the outer end 853. The guide surface 857 can define a convex shape with respect to a top view of the housing 822, and a convex shape with respect to the contact 24 that is disposed in the respective opening 840. Accordingly, as the bottom terminal end 827 is inserted into the upper contact retention portion 848, the guide surface 849 directs the terminal end 827 into the middle portion 852. Alternatively, the guide surface 857 can define a concave shape with respect to a top view of the housing 822, and a concave shape with respect to the contact 24 that is disposed in the respective opening 840.

The lower portion 850 can be substantially cylindrical, or define the shape of a frustum whose outer, or lower, 855 end has a diameter that is greater than its inner, or upper, end 851. The lower portion 850 is thus defined by at least one side wall 856 that extends substantially parallel to the vertical direction, or is angled with respect to the vertical direction.

As shown in FIG. 13D-13F, the upper portions 848 and the lower portions 850 surround the respective electrical contacts 824, and have a diameter that is greater than the cross-sectional dimension of the respective contacts 824 disposed therein. The middle portion 852 defines a cross section that is sized slightly less than or equal the that of the contact 824, and engages the middle portion of the contact body 825. The guide wall 857 provides a transition between the upper portion 848 and the middle portion 852. A radial flange 859 can join the inner, or upper, end 851 of the lower portion 850 to the middle portion 852. The engagement between the portion of the housing 822 that defines middle portion 852 of the contact-opening 840 and the contact 824 retains the contact 824 in position in the housing 822. In this regard, it should be appreciated that any shavings that are created during insertion of the electrical contact, for instance due to interference between the contact 824 and the housing 822 at the middle portion 852 will be disposed in the upper contact-retention portion 848 or the lower contact-retention portion 850, and will thus electrically isolated from shavings of the other adjacent electrical contacts disposed in the housing 822.

The side walls 854 and 856 extend substantially vertically as described above, or can define an angle with respect to the vertical anywhere within a range that can have a lower end between and including 0° and 5°, including 0.5° and 1°, and an upper end between and including 1° and 20°, including 1.5°, 2°, 5°, 10°, and 15°. Likewise, the uppermost end of the middle portion 852 and the uppermost end of the guide surface 857 can define an angle θ with respect to the vertical that can have a lower end between and including 0° and 5°, including 0.5° and 1°, and an upper end between and including 1° and 20°, including 1.5°, 2°, 5°, 10°, and 15°. In this regard, it should be appreciated that the guide surface extend linearly between the middle portion 852 and the upper portion 848.

It should be further appreciated that, although the upper and lower portions 848 and 850 are cylinders or frustums as illustrated, and thus define a circular cross sectional shape, they can alternatively define any suitable alternative cross sectional shape as desired, including square, rectangular, triangular, or any other polygonal shape.

Referring now to FIGS. 14A-B, the connector housing 822 can include a plurality of dimples 846 extending outwardly from the bottom wall 823 and the top wall 828 at a location laterally adjacent the contact-receiving openings 840, or at any suitable alternative locations. The dimples 846 can define a frustum, or can alternatively define a dome-shaped surface defined by a radius, or any suitable alternative-shaped geometric structure. The dimples provide standoff with respect to complementary electrical components, such as a substrate, or printed circuit board, that are to be mated with the opposing terminal ends 826 and 827 of the electrical contacts 824, so as to create a spacing between the electrical component and its corresponding bottom wall 823 or top wall 828 to which electrical component interfaces.

Referring now to FIGS. 15-18, a mold 870 includes an upper die 872 and a lower die 874. One of the dies may be movable with respect to the other, or both dies may be movable with respect to each other. The dies 872 and 874 can be similarly constructed unless otherwise indicated, such that the mold can be formed by inverting the upper die 872 and joining the upper die 872 with the lower die 874. Accordingly, components described in combination with the lower die 874 is equally applicable to the upper die 872 unless otherwise indicated. The directional terms associated with the lower 874 are used to likewise describe the upper die 872, even though the upper die is inverted with respect to the lower die during use. Thus reference numerals as described with respect to elements of the lower die 874 also identify like structures illustrated with respect to the upper die 872. Of course, it should be appreciated that both dies need not be constructed similarly in the manner described and illustrated herein, so long as they are capable of forming a mold cavity configured to produce an electrical connector housing such as the housing 822 described above.

The lower die 874 includes opposing horizontal bottom and top surfaces 876 and 878, respectively, opposing longitudinally elongate vertical side surfaces 880 connected between the bottom surface 876 and the top surface 878, and a pair opposing end surfaces 882 connected between the bottom surface 876 and the top surface 878. The top surface 878 defines an engagement surface configured to engage the complementary engagement surface of the upper die 872.

Figure 16A:
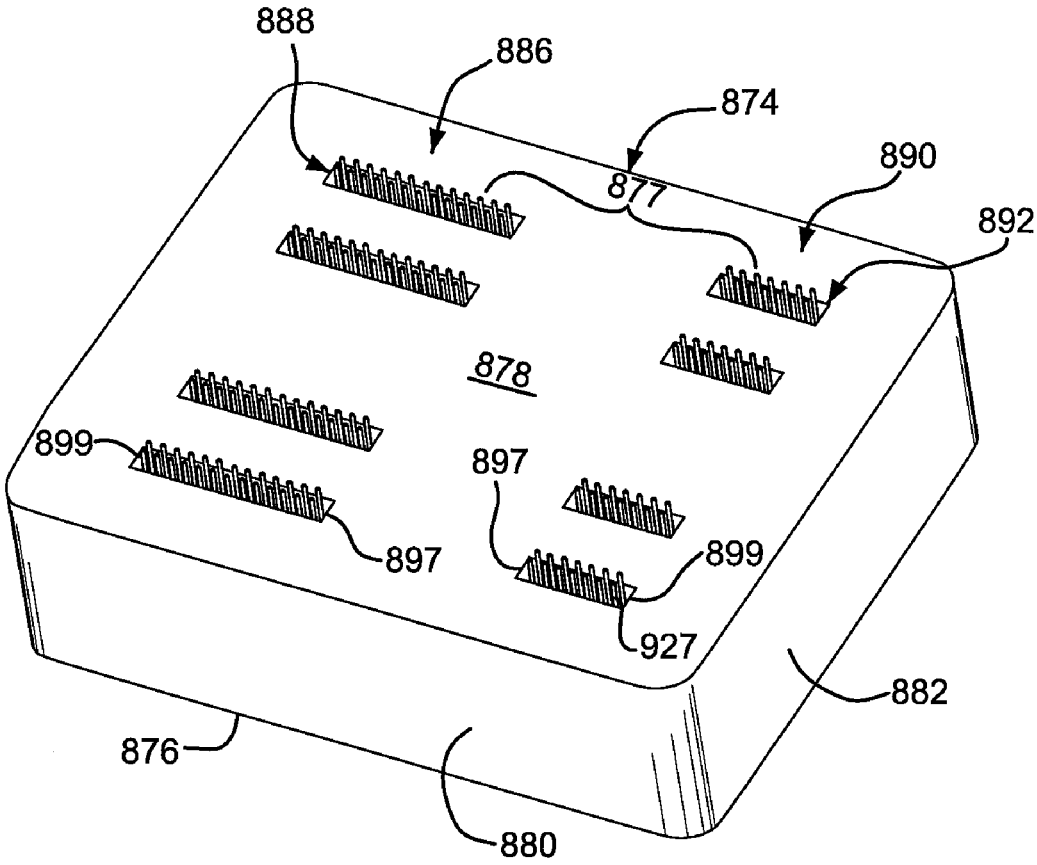
FIG. 16A is a perspective view of the bottom die illustrated in FIG. 15.
Figure 16B:
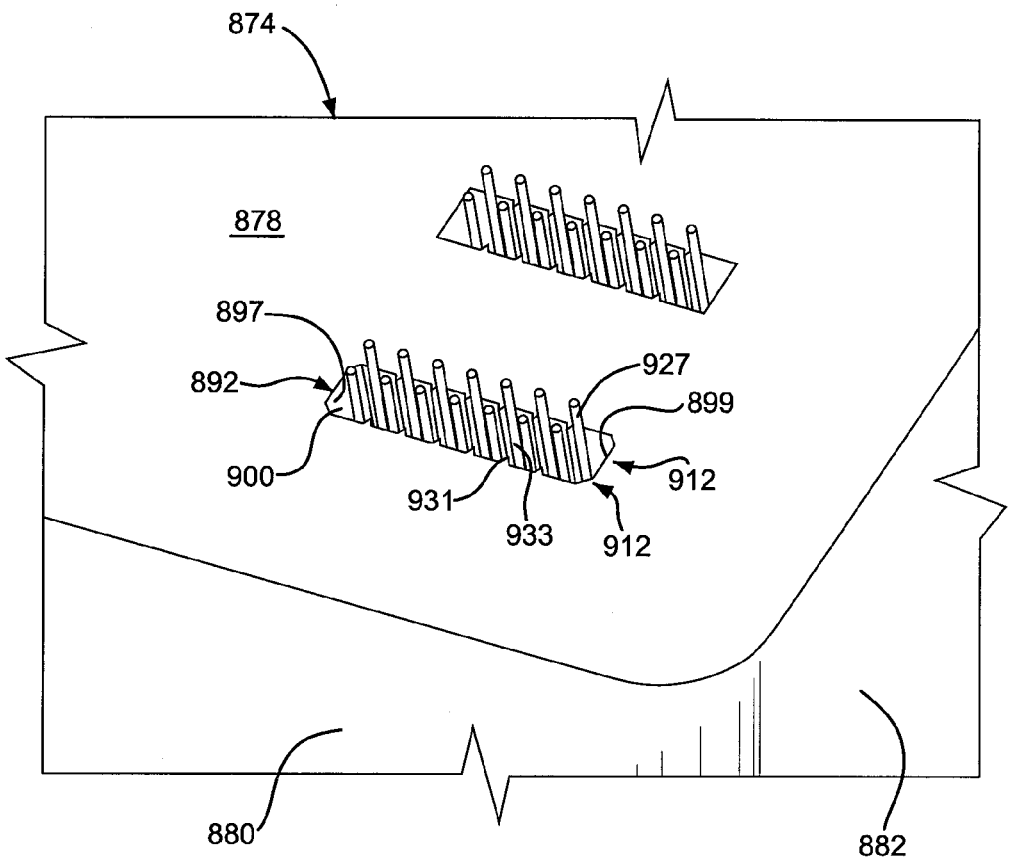
FIG. 16B is an enlarged perspective view of a portion of the bottom die illustrated in FIG. 16A.
Figure 18:
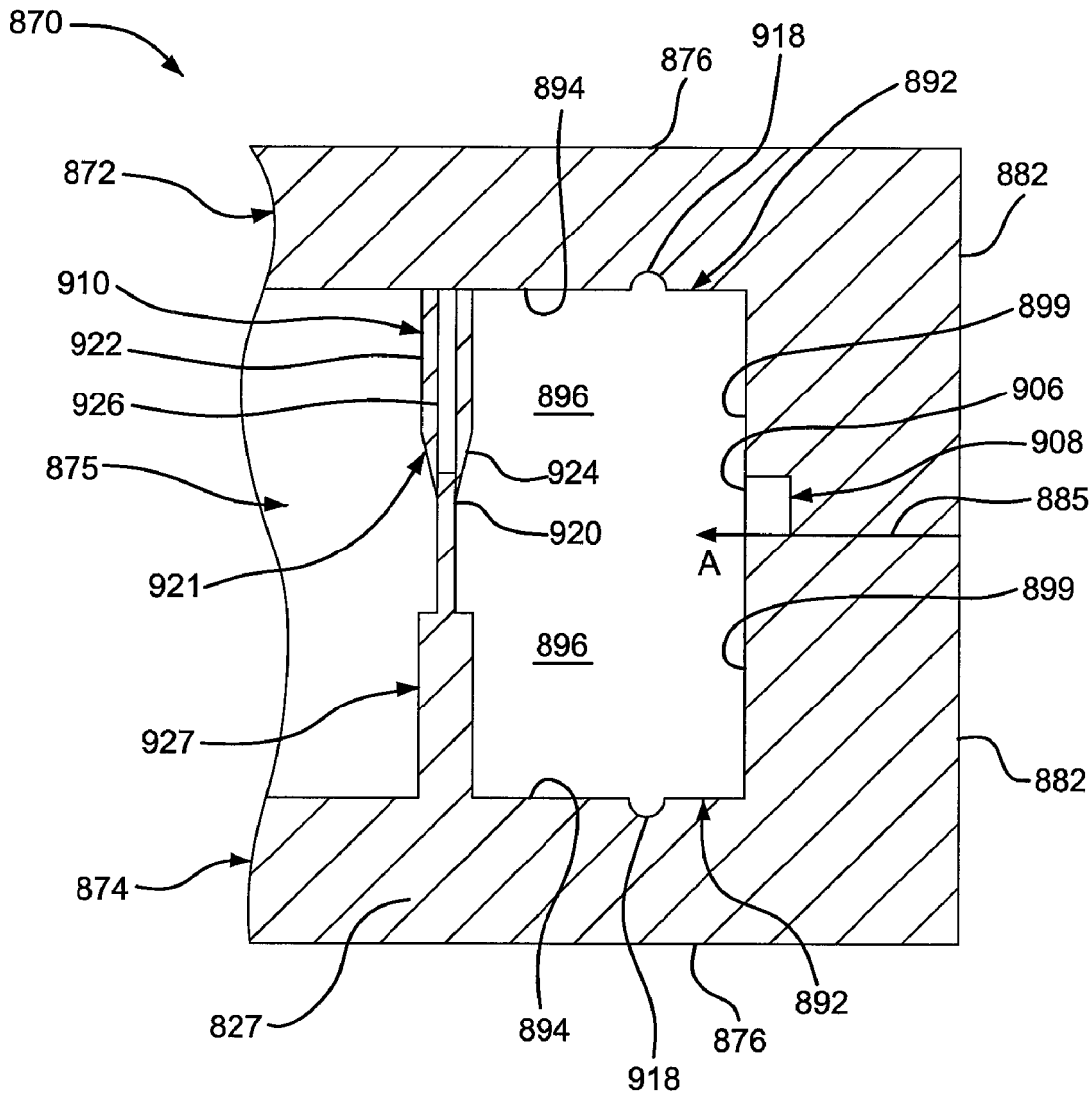
FIG. 18 is an enlarged sectional side elevation view through a portion of a mold of the type illustrated in FIG. 15.

The lower die 874 further defines an array of pockets 877 that extend from the top surface 876 vertically into the die 874. In the illustrated embodiment, the lower die 874 defines a first column 886 of a first plurality of mold pockets 888, and a second column 890 of mold pockets 892. Each column 886 and 890 includes four rows of a second plurality of pockets 888, such that the lower die 874 presents eight pockets 877 in total, though the number of pockets present in the lower die can vary, such that the lower die 874 includes at least one pocket. The pockets of the lower die 874 can be combined with the complementary pockets of the upper die 872 to form corresponding mold cavities when the dies 872 and 874 are brought together. One such mold cavity 875 is illustrated in FIG. 18. In this regard, once the upper die 872 is inverted, and the dies are brought together to form the mold cavity 875, it should be appreciated that the upper die 872 defines an upper wall of the mold cavity 875. An enlarged view of one of the pockets 892 of the lower die 874 is illustrated in FIGS. 16A-B and 18.

In particular, the pocket 892 is defined a horizontal base, opposing longitudinally elongate vertical side walls 96 extending up from the base, and inner and outer end walls 897 and 899, respectively, connected between the side walls 896. Though the pocket 892 is thus illustrated as being generally rectangular, it should be appreciated that the pocket 892 can define any desired geometric shape and, in this regard, can include at least one side wall that can be linear or curved.

As described above, the horizontal base 894 of the upper die 872 defines an upper surface of the mold cavity 875 once the dies 872 and 874 are brought together. The pocket 892 defines an open upper end 900 configured to align with an upper end of a complementary pocket 892 of the upper mold 72 (see FIGS. 17A-B). It should be appreciated that pockets 888 can be constructed as described with reference to pockets 892. Accordingly, though one of the pockets 892 is described in detail herein, it should be appreciated that the description of the pockets 892 applies to the pockets 888 unless otherwise indicated. Thus reference numerals as described with respect to elements of the pockets 892 also identify like structures illustrated with respect to pockets 888. Of course, it should be appreciated that both columns of pockets 888 and 892 need not be constructed identically so long as they are capable of forming a mold cavity configured to produce an electrical connector housing 822 such as the connector 22 described above.

Though the side walls 896 are illustrated as presenting a flat inner surface, it should be appreciated that the inner surface of the side walls 896 can include a texture or contour that corresponds to a desired contour of the side walls 830 of the connector housing 822. For instance, the side walls 896 of the pocket 892 can present inner surfaces that have vertically extending ribs and recesses of the type described above with reference to FIG. 8 that are sized and shaped to define the recesses 834 and ribs 836 described above when the pocket 892 is filled with injection molded plastic.

With continuing reference to FIGS. 16A-B and 18, the lower die 874 includes structure in the mold cavity 875 configured to form openings in the resulting connector housing that correspond to a portion of the contact-receiving openings 840 described above. In the illustrated embodiment, a plurality of posts 927 is disposed in each pocket 927 and extends vertically up from the base 894. The posts 927 can be identically or substantially identically constructed as illustrated, and extend along two rows 912 in the illustrated embodiment. Each contact post 927 is configured to create a cavity in the resulting connector housing such as the lower portion 850 and middle portion 852 of the contact-receiving openings 840 described above. Each row 912 can include any desired number of posts to produce an electrical connector having the desired number of electrical contacts. In the illustrated embodiment, each row 912 in pockets 892 contain seven posts 927. Each row in pockets 888 includes thirteen posts 927. The posts in each row 912 can be laterally aligned with the posts of the other row 912 as illustrated, or can be staggered if desired.

The posts 927 extend up from the base 894 a distance greater than the height of the side walls 896 and end walls 897 and 899 of the lower die 874. Thus, the posts 927 extend vertically beyond the top surface 878 of the die 874. The posts 927 can be integrally formed with the base 894 or discreetly attached to the base 894 using any known fastener. Each post 927 defines a substantially cylindrical body 929 having a lower portion 931 that can be substantially cylindrical, and an upper portion 933 that projects upward from a substantially central location on the upper surface of the lower portion 931. The upper portion 933 defines a diameter less than that of the lower portion 931.

The lower portion 931 may be cylindrical, or can define the shape of a frustum such that the lower portion 931 defines a void in the mold cavity 875 that is configured to produce a lower portion of a contact-receiving opening, such as the lower portion 850 of the contact receiving opening 840 described above. Thus, the outer side wall of the lower portion 931 can define an angle with respect to the vertical within a range that can have a lower end between and including 0° and 5°, including 0.5° and 1°, and an upper end between and including 1° and 20°, including 1.5°, 2°, 5°, 10°, and 15°. The upper portion 933 can define a cylindrical shape having a diameter corresponding to the shape of the middle portion 852 of the contact-receiving opening 840 described above.

As shown in FIG. 18, the lower dies 874 can include additional structure in each pocket 877 as desired. For instance, as illustrated with respect to the pockets 892, a plurality of recesses 918 can extend vertically down into, but not through, the base 894. The recesses 918 can be arranged in a pair of rows such that each recess is disposed laterally adjacent a corresponding post receptor 910. Alternatively, the rows can be disposed at a location offset from the post receptor 910*s*, such that the recesses 918 are disposed laterally outward with respect to the corresponding post receptors 910 as described above with respect to recessed 118. Alternatively still, the recesses 918 can be disposed anywhere in the pocket 892 as desired. When the upper die 872 and lower die 874 are brought into contact with each other, and the injection molded plastic is injected into the mold cavity 875, the plastic conforms to the shape of the recesses 918 to form dimples having a desired a size and shape such as the dimples 46 described above.

Figure 17A:
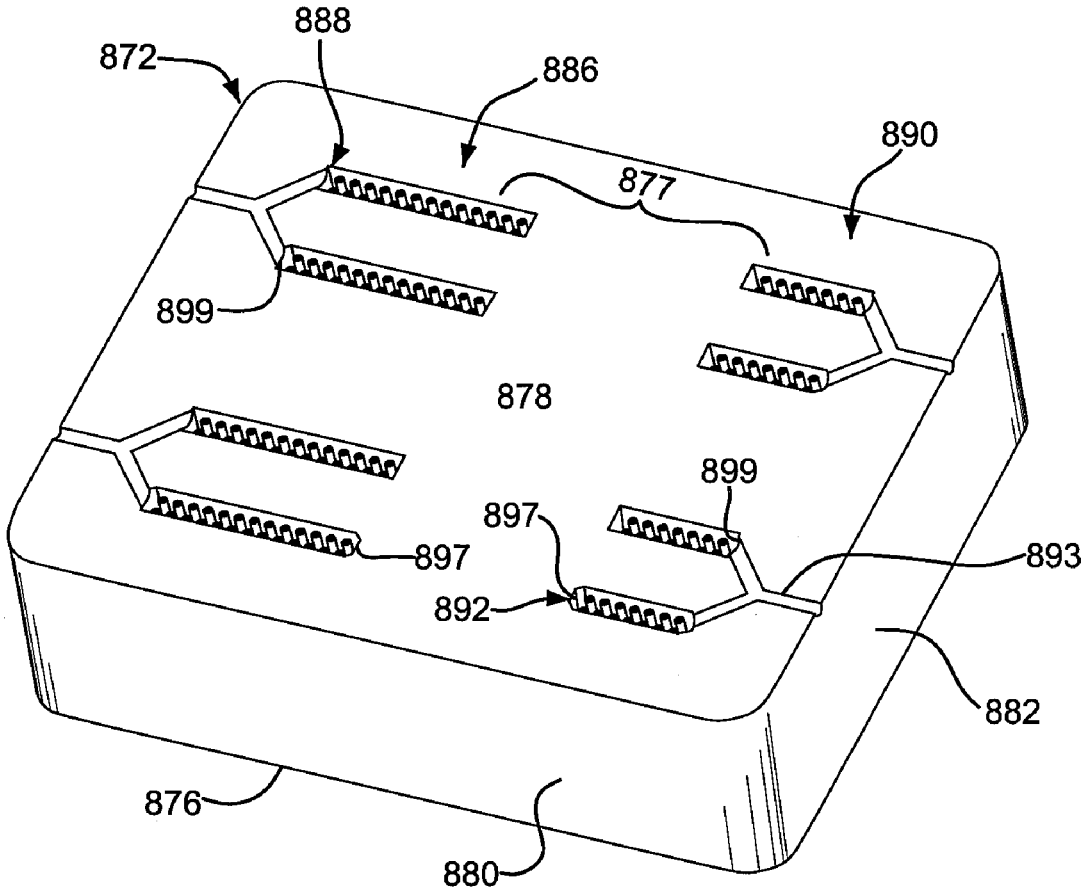
FIG. 17A is a perspective view of the top die illustrated in FIG. 15.
Figure 17B:
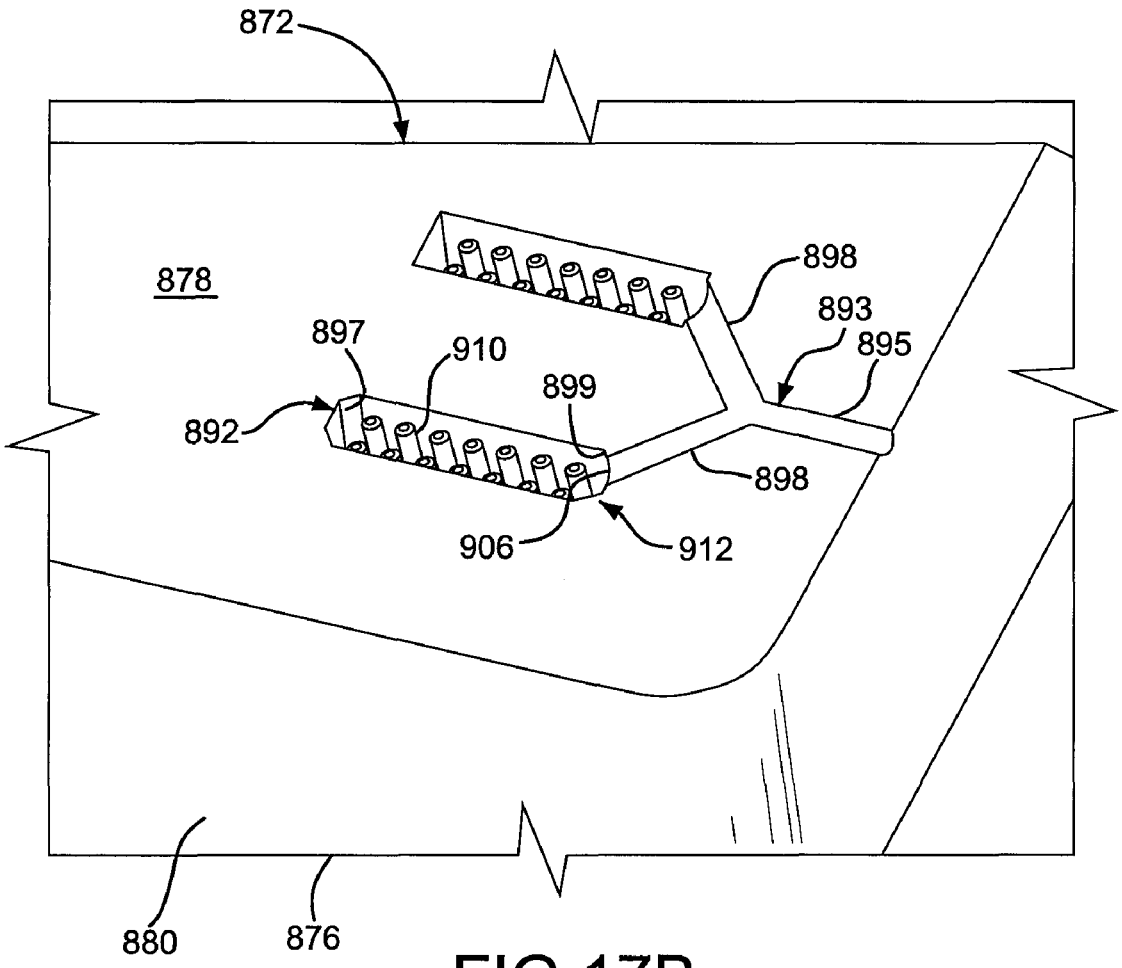
FIG. 17B is an enlarged perspective view of a portion of the top die illustrated in FIG. 17A.

Referring now to FIGS. 17A-18, the upper die 872 likewise includes structure disposed in the mold cavity 875 that is configured to form openings in the resulting connector housing that correspond to a portion of the contact-receiving openings 840 described above. In the illustrated embodiment, a plurality of post receptors 910 is disposed in each pocket 927 and extends vertically up from the base 894. The post receptors 910 can extend up from the base 894 a distance less than the height of the side walls 896 and end walls 897 and 899 of the upper die 872. Thus, the post receptors 910 are vertically recessed with respect to the top surface 878 of the die 872. The posts 927 can be integrally formed with the base 894 or discreetly attached to the base 894 using any known fastener.

The post receptors 910 can be identically or substantially identically constructed as illustrated, and extend along two rows 912 in the illustrated embodiment. Each post receptor 910 configured to create a cavity in the resulting connector housing such as the upper portion 848 of the contact-receiving openings 840 described above. Each row 912 can include any desired number of post receptors 910 to produce an electrical connector having the desired number of electrical contacts. In the illustrated embodiment, each row 912 in pockets 892 contain seven post receptors 910. Each row in pockets 888 includes thirteen post receptors 910. The post receptors 910 in each row 912 can be laterally aligned with the posts of the other row 912 as illustrated, or can be staggered if desired.

Each post receptor 910 defines an upper portion 921 and an opposing lower portion 922. The lower portion 922 can be substantially cylindrically shaped, or can alternatively define the shape of a frustum as described above with respect to the posts 927, and thus defines a substantially circular cross-section. The upper portion 921 can define a lower end that is adjoined to the lower portion 922, and a side wall 924 that curves inwardly in a vertically upward direction and terminates at an upper end 920. The side wall 924 can define a convex surface with respect to the mold cavity 875. Alternatively, the side wall 924 can define a concave surface with respect to the mold cavity 875, or can alternatively still define a substantially linear surface that extends radially inward along a direction from the lower portion 922 toward the upper terminal end 920. Thus, the side wall 924 can be geometrically configured to define a contact guide surface of a connector housing, such as the contact guide surface 857 as described above.

It should be appreciated that the lower portion 922 and the posts 927 could alternatively define any suitable geometric structure capable of producing a contact-receiving opening in an electrical connector housing that defines any suitable geometric structure, including square, rectangular, triangular, or any other polygonal shape, such that a cross section is produced that is suitable for press-fitting electrical contacts such that any shavings produced from the contact are isolated from the other contacts of the connector.

With continuing reference to FIGS. 17A-18, each post receptor 910 can include a post-receiving aperture 926 extending vertically into the upper end 920. The aperture 926 has a vertical length sufficient to receive a terminal portion of the upper end 920 of the post 927. Thus, the aperture 926 can define a cross-section substantially equal to the outer diameter of the upper end 920 such that the upper end 920 seals the aperture with respect to an ingress of injection molded plastic during the molding operation. Alternatively or additionally, a seal such as the doughnut shaped seal 135 can be disposed in the upper end 920 of the post receptor 910.

The aperture 926 can be centrally disposed in the post receptor 910, and can extend down from the upper end 120 to the base 894, or can terminate above the base at a location sufficient to receive the terminal end of the upper portion 920 of the post 927.

The upper die 872 further includes a plurality of injection conduit sections 893, each having a main channel 895 that is connected to a pair of diverging forks 898 which, in turn, each define a terminal end that defines an injection port section 906 that extends through the outer end wall 899 of a corresponding one of the pockets 877. The injection conduit sections 893 extend vertically downward into the top surface 878 of the upper die 872. When the upper die 872 is joined to the lower die 874, the complementary top walls 878 define a centrally disposed seal line 885 at the interface thereof, and the pockets 877 form an interior mold cavity 875 in fluid communication with an injection port 908. During operation of the injection molding process, the injection molding material, such as plastic, flows through the injection conduits 902 and into the respective mold cavities along the direction of Arrow A. The injection molding material conforms to the exposed surfaces of the posts 927 and the post receptors 910. It should be appreciated that like injection conduit sections could be formed in the lower die 874 and aligned with those of the upper die 872 if desired.

It should thus be appreciated that a method can be provided for constructing an electrical connector. The method can include the step of providing a first die that defines a first mold pocket and a post disposed in the first mold pocket. The method can further include the step of providing a second die defining a second mold pocket and a post receptor disposed in the second mold pocket. The method can further include the step of joining the first and second dies, such that the first and second mold pockets combine to form a mold cavity, wherein the post is received in the post receptor. The post receptor defines a inwardly flared surface that is configured to produce a guide surface for an electrical contact that is inserted into the resulting contact-receiving cavity.

The above-described method can further include the steps of introducing an injection molded plastic into the mold cavity, allowing the injection molded plastic to harden, and subsequently moving at least one of, or both of, the dies away from each other so as to remove the molded product from the mold cavity. The molded product can be an electrical connector housing such as the housing 822 as described herein. An electrical contact can then be inserted into an opening formed in the plastic housing that was defined by the post and post receptor during the injection molding process.

It should be appreciated that each pocket 888 and 892 can include any number of posts 927, post receptors 910, and recesses 918 as desired, depending for instance on the number of desired electrical contacts in the electrical connector produced from the mold cavity 875. The side walls and end walls of each pocket can likewise define any suitable length as desired.

The injection molding material, such as injection molded plastic, can be injected into the mold cavity 875 via the injection port 908 along the direction of Arrow A. The molten plastic fills the mold cavity 875, and conforms to the shape of the cavity 875, which can be defined by the walls of the pockets 877, the posts 927, the post receptors 910, the recesses 918, and any additional structure placed therein. It should be appreciated that shape of the mold cavity 875 is not limited to being defined by the above-identified structure, and that certain structure may be removed. Likewise, additional structure may be added to further define the shape of the mold cavity 875 as desired. Thus, the molten plastic hardens to produce an electrical connector housing, for instance of the type as described above with reference to electrical connector 820.

What is claimed:

1. An electrical connector comprising:

an insulative connector housing that defines two contact-receiving openings; and two electrically conductive contacts, each of the two electrically conductive contacts received in a respective one of the two contact-receiving openings and each of the two electrically conductive contacts retained in the respective contact-receiving opening by an interference fit created between the insulative connector housing and the two electrically conductive contacts, wherein if at least one of the two electrical contacts produces an electrically conductive shaving as it is inserted into the respective contact-receiving opening, the respective contact-receiving opening retains the electrically conductive shaving.

2. The electrical connector as recited in claim 1, wherein the two contact-receiving openings each define an upper contact-portion, a lower contact-portion, and a middle portion, and the upper and lower contact portions are configured to receive the electrically conductive shaving.

3. The electrical connector as recited in claim 1, wherein each of the two contact-receiving openings are sized greater than the respective electrically conductive contacts.

4. The electrical connector as recited in claim 3, wherein each of the two contact receiving openings includes a portion that is defined by a side wall that is outwardly sloped along a direction toward one of a respective top and bottom wall of the connector housing.

5. The electrical connector as recited in claim 4, wherein the electrically conductive contacts extend vertically, and each of the side walls defines an angle with respect to the respective one of the electrically conductive contacts.

6. The electrical connector as recited in claim 5, wherein the angle has a lower end between and including 0° and 5°, and an upper end between and including 1° and 20°.

7. The electrical connector as recited in claim 6, wherein each of the portions defines a shape of a frustum.

8. The electrical connector as recited in claim 7, wherein the portions each comprises an upper portion of the two respective contact-receiving openings, wherein each of the two contact receiving openings further defines a lower contact-portion and a middle portion, and the upper and lower contact portions are configured to receive the electrically conductive shaving.

9. The electrical connector as recited in claim 3, wherein each of the two contact receiving openings includes a portion that is defined by a side wall that is outwardly curved along a direction toward one of a respective top and bottom wall of the connector housing.

10. The electrical connector as recited in claim 9, wherein the portions each comprises an upper portion of the two respective contact-receiving openings, wherein each of the two contact receiving openings further defines a lower contact-portion and a middle portion, and the upper and lower contact portions are configured to receive the electrically conductive shaving.

11. The electrical connector as recited in claim 10, wherein each of the lower portions is defined by a side wall that is outwardly curved along a direction from the middle portion toward the lower wall of the connector housing.

12. The electrical connector as recited in claim 3, wherein each of the two contact receiving openings includes a portion that is defined by a side wall that extends parallel to the respective electrically conductive contact.

13. The electrical connector as recited in claim 12, wherein the portions each comprises an upper portion of the two respective contact-receiving openings, wherein each of the two contact receiving openings further defines a lower contact-portion and a middle portion, and the upper and lower contact portions are configured to receive the electrically conductive shaving.

14. The electrical connector as recited in claim 13, wherein each of the lower portions is defined by a side wall that is outwardly curved along a direction from the middle portion toward the lower wall of the connector housing.

15. The electrical connector as recited in claim 1, wherein the connector housing is defined by a mold that is configured to receive injection-molded plastic, the mold including:

a die defining a first mold pocket and comprising a first base and a post extending from the first base and disposed in the first mold pocket;

a complementary die defining a second mold pocket and comprising a second base and a post receptor extending from the second base and disposed in the second mold pocket, wherein the post receptor defines an outer surface that flares inwardly along a direction from a lower end of the post receptor toward the an upper end of the post receptor, and wherein the die and the complementary die are configured to be joined so as to define a mold cavity.

16. The electrical connector as recited in claim 1, wherein the connector housing is defined by a mold that is configured to receive injection-molded plastic, the mold comprising:

a die defining a first mold pocket configured to be joined with a complementary die having a second mold pocket so as to define a mold cavity; and a contact receptor extending from the die inside the first mold pocket, the contact receptor including a contact receptor body defining a lower terminal end, an upper terminal end disposed opposite the lower terminal end, and a contact-receiving aperture extending into the contact receptor body, wherein the lower terminal end has a cross-sectional dimension greater than that of the upper terminal end.

* * * * *